US007291247B2

(12) United States Patent
Lee

(10) Patent No.: US 7,291,247 B2
(45) Date of Patent: Nov. 6, 2007

(54) ABSORBENT SHEET MADE WITH PAPERMAKING FIBERS WITH DURABLE CURL

(75) Inventor: Jeffrey A. Lee, Neenah, WI (US)

(73) Assignee: Georgia-Pacific Consumer Operations LLC, Atlanta, GA (US)

( * ) Notice: Subject to any disclaimer, the term of this patent is extended or adjusted under 35 U.S.C. 154(b) by 32 days.

(21) Appl. No.: 10/625,086

(22) Filed: Jul. 23, 2003

(65) Prior Publication Data

US 2004/0016524 A1 Jan. 29, 2004

Related U.S. Application Data

(62) Division of application No. 09/793,874, filed on Feb. 27, 2001, now Pat. No. 6,627,041.

(60) Provisional application No. 60/187,105, filed on Mar. 6, 2000.

(51) Int. Cl.

| | |
|---|---|
| ***D21B 1/12*** | (2006.01) |
| ***D21B 1/14*** | (2006.01) |
| ***D21D 1/16*** | (2006.01) |
| ***D21C 5/02*** | (2006.01) |
| ***D21C 9/16*** | (2006.01) |

(52) U.S. Cl. ..... 162/146; 162/9; 162/157.6; 162/78; 162/4; 428/221; 604/378

(58) Field of Classification Search ..... 162/23–28, 162/4, 9, 68, 65, 76, 78, 80, 90, 57, 82–83, 162/157.6, 146; 241/28, 21; 428/221–222; 8/116.1, 120, 181; 604/375–378
See application file for complete search history.

(56) References Cited

U.S. PATENT DOCUMENTS

| | | | | | |
|---|---|---|---|---|---|
| 2,008,892 | A | | 7/1935 | Asplund | |
| 2,516,384 | A | | 7/1950 | Hill et al. | |
| 3,023,140 | A | | 2/1962 | Textor | 162/24 |
| 3,382,140 | A | | 5/1968 | Henderson et al. | 162/28 |
| 3,507,743 | A | | 4/1970 | Cartsunis et al. | 162/73 |
| 3,773,610 | A | | 11/1973 | Shouvlin et al. | 162/19 |
| 3,808,090 | A | | 4/1974 | Logan et al. | 162/23 |
| 3,873,412 | A | | 3/1975 | Charters et al. | 162/25 |
| 3,948,449 | A | | 4/1976 | Logan et al. | 241/41 |
| 4,036,679 | A | | 7/1977 | Back et al. | 162/9 |
| 4,166,001 | A | * | 8/1979 | Dunning et al. | 162/111 |
| 4,187,141 | A | | 2/1980 | Ahrel | 162/23 |
| 4,259,148 | A | | 3/1981 | Beath et al. | 162/24 |
| 4,409,065 | A | * | 10/1983 | Kasser | 162/9 |
| 4,431,479 | A | * | 2/1984 | Barbe et al. | 162/9 |
| 4,455,195 | A | | 6/1984 | Kinsley | 162/13 |
| 4,455,237 | A | * | 6/1984 | Kinsley | 210/767 |
| 4,488,932 | A | | 12/1984 | Eber et al. | 162/9 |
| 4,548,674 | A | | 10/1985 | Hageman et al. | 162/5 |
| 4,734,160 | A | | 3/1988 | Moldenius | 162/71 |
| 4,756,798 | A | | 7/1988 | Lacjhenal et al. | 162/24 |
| 4,889,597 | A | * | 12/1989 | Bourbon et al. | 162/157.6 |
| 4,898,642 | A | * | 2/1990 | Moore et al. | 162/157.6 |
| 4,915,785 | A | | 4/1990 | Siminoski et al. | 162/78 |
| 4,938,842 | A | | 7/1990 | Whiting et al. | 162/78 |
| 4,976,819 | A | | 12/1990 | Minton | 162/9 |
| 5,137,537 | A | * | 8/1992 | Herron et al. | 8/120 |
| 5,211,809 | A | | 5/1993 | Naddeo et al. | 162/6 |
| 5,244,541 | A | | 9/1993 | Minton | 162/28 |
| 5,296,100 | A | | 3/1994 | Devic | 162/78 |
| 5,348,620 | A | | 9/1994 | Hermans et al. | 162/9 |
| 5,384,011 | A | | 1/1995 | Hazard, Jr. | 162/9 |
| 5,384,012 | A | | 1/1995 | Hazard, Jr. | 162/9 |
| 5,501,768 | A | | 3/1996 | Hermans et al. | 162/9 |
| 5,571,377 | A | | 11/1996 | Tibbling et al. | 162/52 |
| H1704 | H | | 1/1998 | Wallajapet et al. | 536/30 |
| 5,709,774 | A | | 1/1998 | Naieni | 162/9 |
| 5,716,703 | A | * | 2/1998 | Payne | 428/378 |
| 5,728,085 | A | * | 3/1998 | Widlund et al. | 604/378 |
| 5,730,737 | A | * | 3/1998 | Widlund et al. | 604/378 |
| 5,755,926 | A | | 5/1998 | Hankins et al. | 162/6 |
| 5,772,845 | A | | 6/1998 | Farrington, Jr. et al. | 162/109 |
| 5,834,095 | A | | 11/1998 | Dutkiewicz et al. | 428/191 |
| 5,843,852 | A | * | 12/1998 | Dutkiewicz et al. | 442/334 |
| 5,858,021 | A | * | 1/1999 | Sun et al. | 8/125 |
| 5,893,525 | A | | 4/1999 | Gingras | 241/298 |
| 5,997,689 | A | | 12/1999 | Bokstrom | 162/6 |
| 6,372,085 | B1 | * | 4/2002 | Hsu et al. | 162/4 |
| 6,413,362 | B1 | * | 7/2002 | Hu | 162/4 |

(Continued)

FOREIGN PATENT DOCUMENTS

| | | |
|---|---|---|
| EP | 0 096 460 | 12/1983 |

(Continued)

*Primary Examiner*—José A. Fortuna
(74) *Attorney, Agent, or Firm*—Michael W. Ferrell

(57) ABSTRACT

A process for bleaching high bulk cellulosic fiber and producing a durable elevated curl index includes: (a) concurrently bleaching, heat treating and convolving cellulosic fiber pulp at elevated temperature and pressure at high consistency generally under conditions selected so as to preclude substantial fibrillation and attendant paper strength and fiber bonding development; and (b) recovering the pulp wherein the length weighted curl index of the treated fiber is at least about 20% higher than the length weighted curl index of the fiber prior to the heat treatment and convolving thereof. Preferably, the curl imparted to the fiber persists upon treatment for 30 minutes in a laboratory disintegrator at 3000 rpm at 1% consistency at a temperature of 125° F. Moreover, the curl may be imparted to the fiber in a disk refiner at very short residence times, on the order of several seconds or less. In general, the process is carried out in the presence of saturated steam at a pressure of from about 5 to about 150 psig.

19 Claims, 4 Drawing Sheets

U.S. PATENT DOCUMENTS

| | | | | |
|---|---|---|---|---|
| 6,506,282 | B2 * | 1/2003 | Hu et al. | 162/5 |
| 6,562,192 | B1 * | 5/2003 | Hamilton et al. | 162/56 |
| 6,627,041 | B2 * | 9/2003 | Lee | 162/9 |
| 6,770,576 | B2 * | 8/2004 | Cook et al. | 442/59 |
| 6,780,201 | B2 * | 8/2004 | Sun et al. | 8/125 |
| 6,889,790 | B2 * | 5/2005 | Pertusi | 180/252 |
| 6,899,790 | B2 | 5/2005 | Lee | 162/4 |
| 2001/0020520 | A1 * | 9/2001 | Hu et al. | 162/9 |
| 2001/0040015 | A1 * | 11/2001 | Lee | 162/9 |
| 2002/0011317 | A1 * | 1/2002 | Lee | 162/9 |
| 2004/0016524 | A1 * | 1/2004 | Lee | 162/9 |
| 2004/0127869 | A1 * | 7/2004 | Hu et al. | 604/376 |
| 2005/0051286 | A1 * | 3/2005 | Carels et al. | 162/9 |
| 2005/0145348 | A1 * | 7/2005 | Lee | 162/4 |

FOREIGN PATENT DOCUMENTS

| | | |
|---|---|---|
| EP | 0 101 319 | 2/1984 |
| EP | 0 252 650 | 1/1988 |
| EP | 0 440 472 | 8/1991 |
| FR | 2 747 406 | 10/1997 |
| WO | WO 94/20674 | 9/1994 |
| WO | WO 96/20308 | 7/1996 |
| WO | WO 97/43483 | * 11/1997 |
| WO | WO 98/27269 | 6/1998 |

* cited by examiner

ABSORBENT SHEET MADE WITH PAPERMAKING FIBERS WITH DURABLE CURL

CROSS REFERENCE TO RELATED APPLICATION

This application is a divisional of U.S. patent application Ser. No. 09/793,874, filed on Feb. 27, 2001 now U.S. Pat. No. 6,627,041, issued Sep. 30, 2003, which was based upon and incorporates material from U.S. Provisional Patent Application Ser. No. 60/187,105, filed Mar. 6, 2000. The priorities of the foregoing patent and patent applications are hereby claimed.

TECHNICAL FIELD

The present invention relates generally to papermaking fibers and more specifically to a method of bleaching and providing durable curl to fiber by way of high temperature and pressure, low mechanical energy processing.

BACKGROUND

Refining and bleaching cellulosic fibers for papermaking is well-known. Various systems and processes are used for preparing pulps, including chemical pulping processes such as the Kraft process, mechanical processes, chemi-mechanical processes, thermo-mechanical processes and so forth. The art is appreciated by reference to the following patents and patent applications.

U.S. Pat. No. 2,008,892 to Asplund discloses an apparatus for refining wood chips into mechanical pulp provided with a grinding portion including a stationary disk, and a rotating disk.

There is disclosed in U.S. Pat. No. 2,516,384 to Hill et al. a process for mechanically curling cellulose fibers. The method of the '384 patent includes forming the pulp in the presence of a limited amount of aqueous liquid into small, discreet nodules of fibers and causing the nodulated pulp to form into rotatable units and travel roll wise under compression, thereby subjecting the nodules to mechanical pressure with continuous reorientation of the nodules relative to the direction of applied pressure and thus imparting kinks, bends, and twists to the pulp fibers or fiber bundles. See Col. 4, lines 73 and following, through Col. 5, lines 1-20.

U.S. Pat. No. 3,023,140 to Textor discloses adding hydrogen peroxide and wood chips to a refiner for the purpose of simultaneously bleaching and refining the chips. (See FIGS. 2 and 3).

U.S. Pat. No. 3,382,140 to Henderson et al. is directed to a process for fibrillating cellulosic fibers. Cellulosic high consistency papermaking pulp in the form of a semi-solid, non-flowable and nonpumpable lumping mass composed of defibered fibers is continuously refined by passage through a refining space comprising opposed disk like working surfaces relatively rotatable about a common axis wherein the pulp is continuously maintained packed under high compression to cause defibrillation by interfiber friction along the surfaces of the individual separated fibers without substantially fracturing the fibers. In general, fibrous material is defibered and then dewatered to increase his consistency to a level where it forms a semisolid, nonflowable, moist mass adapted for high consistency refining. Pulp consistency in the range of between about 10% and about 60% with the fibers in intimate contact; preferably between about 20 and 35% is satisfactory. If the consistency is much below 10% (according to the patent) the amount of water present may act as a lubricant preventing the desired refining by inter-fiber friction. If much greater than 60%, the pulp will be too dry which may result in burning under the inter fiber friction. Examples of the '140 patent teach mechanical power input of from about 5 to about 40 HP day/ton of pulp produced.

There is disclosed in U.S. Pat. No. 3,773,610 to Shouvlin et al. a pressurized system for pulp refining including pressurized double disk treatment. According to the '610 patent, all fibrous materials are passed through a series of treatments under a steam pressurized atmosphere of from 10 to 150 psig and a temperature of between 115° C. and 200° C. in the absence of accompanying liquid. The raw fibrous materials are initially passed through a tube in which they conditioned by either the steam atmosphere, or by liquid chemicals under steam pressure, and then are passed between simultaneously rotating disks of a double disk refiner which is also under steam pressure. Subsequent to treatment with the disks the fibrous materials are passed to another conditioning tube, such as a digester or a bleach tower where they are further conditioned by liquid chemicals under the same steam pressurized conditions. The fibrous materials may thereafter be washed, cooled and/or pressed.

U.S. Pat. No. 3,808,090 to Logan et al. relates to a method of making wood pulp involving the mechanical abrasion of wood particles in the presence of water in an inert gaseous atmosphere. According to the process, wood particles are fed into a substantially closed chamber where they are mechanically abraided in the presence of water in an inert gaseous atmosphere (steam) at an environmental pressure of 10-60 psig, a temperature of 160°-300° F. and under a power consumption of 50-150 HP day/ton. In the '090 patent the Aspland process is characterized as suitable only for low quality pulp. It is noted that the conditions of the Aspland process are selected to provide mechanical reduction of the wood into fibers with the least possible energy input. To this end, high pressures of the order of 115-150 psig and relatively low energy input of the order of 7-12 HP day/ton are employed to obtain the best results. See Col. 1, lines 51-65.

U.S. Pat. No. 3,873,412 to Charters et al. relates to a method of mechanically refining a mixture of Kraft and semichemical pulp. The method is used for producing pulp for use in the manufacture of Kraft type products such as liner board and bag grade paper comprising the steps of steaming small segments of fibrous material, defiberizing the same in a pressurized atmosphere at an elevated temperature and, while the resultant fiber products are still hot, mixing them with hot Kraft pulp and then refining the mixture so obtained.

U.S. Pat. No. 3,948,449 to Logan et al. is directed to an apparatus for the treatment of lignocellulosic material. The '449 patent also relates to the production of a mechanical pulp of improved strength properties. The lignocellulosic material is fed into a substantially closed chamber where it is mechanically abraided under a power input of 15 or more HP day/ton. During the abraiding step the material is maintained in an inert gaseous atmosphere at a pressure of 10-80 psig, preferably 20-40 psig. It is noted in the '449 patent that the Asplund process is well known in the industry for the manufacture of low grade pulps for employment in the manufacture of roofing and flooring felts. The system involves generally presteaming wood chips followed by refining under high pressure. The products are not suitable for high quality or high strength papermaking because of their inherent low strength and other poor papermaking qualities.

U.S. Pat. No. 4,036,679 to Back et al. is directed to a process for producing convoluted and fiberized cellulose fibers and sheet products. The process includes the application of contortive forces to a pulp mass under controlled operating conditions, wherein the feed rate, work space gap and relative rate of movement of the working elements applying the contortive forces are correlated to maintain the work space filled with fibers under sufficient compression.

U.S. Pat. No. 4,187,141 to Ahrel et al. relates to the production of bleached wood pulp from wood chips using a disk refiner. In this patent it is disclosed to impregnate wood chips with an alkaline bleaching liquid prior to defibrating the chips in the refiner.

U.S. Pat. No. 4,409,065 to Kasser discloses a method of making an improved bag from Kraft pulp including a curlation step before web formation. The curlation step is preferably carried out promptly before the web is formed.

U.S. Pat. No. 4,431,479 to Barbe et al. is directed to a method for treating pulp fibers that have already been curled. The method includes subjecting the pulp to a heat treatment while the pulp is at a high consistency, thereby rendering the curl permanent to subsequent mechanical action. The permanent curl has advantages for paper machine runnability and for increasing the toughness of the finished product. During the process of papermaking most of the curl in both high consistency refined mechanical and high yield sulfite pulp is lost in the subsequent steps of handling at low consistency and high temperatures. See Col. 3, lines 20-29. In the '479 patent the method of curling takes place at medium to high consistency (15%-35%) and may be a high consistency disk refining action as is generally used in pulp manufacture. Col. 4, lines 32-35. According to the '479 patent, it is seen that the process is highly effective for ligno cellulosic pulp fibers, for example, mechanic pulp and high yield sulfite pulp fibers. The treatment reportedly has no effect on cellulosic pulp fibers which contain little or no lignin. Col. 8, lines 4-10. The heat treatment process described in the '479 patent takes place in a digester at a temperature of about 150° C. after the fibers have been curled. Generally, the method is reported useful for treating high yield or mechanical pulps which have been curled by a high consistency action which method includes subjecting the pulp to a heat treatment at temperature of 100° C.-170° C. for a time varying between 60 minutes and two minutes while the pulp is at a high consistency, 15%-35% to render the curl permanent.

U.S. Pat. No. 4,455,195 to Kinsley is directed to a fibrous filter media and processed for producing it. The process involves selection of a lignin containing fiber source having a lignin content of at least about 10% and thermal mechanically pulping the fiber source under temperature/pressure conditions of 300° F. –350° F./50 psig-120 psig and a refiner energy utilization of about 8-35 HPD/ADT. The thermal mechanically produced fibers are characterized by a high degree of stiffness and an extremely smooth surface free of fine fibril formation and thus are substantially non-self-bonding.

U.S. Pat. No. 4,488,932 to Eber et al. discloses a method of making fibrous webs of enhanced bulk. See also European Patent Publication No. 0 101 319. Webs are produced by subjecting hydrophilic papermaking fibers to mechanical deformation, e.g. hammermilling sufficient to deform the fibers without substantial fiber breakage, dispersing the resulting curled or kinked treated fibers, preferably in admixture with conventional papermaking fibers in an aqueous medium, to form a fiber furnish, and forming a wet laid web from the resulting fiber furnish within a period of time, e.g. within five minutes, such that the deformations of the treated fibers are at least partially retained and impart enhanced bulk and softness to the finished fibrous web.

U.S. Pat. No. 4,548,674 to Hageman et al. is directed to a method of regenerating waste paper. Waste paper containing polymeric contaminants is broken down in the presence of an acidic aqueous solution containing at least one peracid. Particular peracids disclosed include permonosulphuric acid and peracetic acid.

U.S. Pat. No. 4,734,160 to Moldenius et al. discloses a method of peroxide bleaching lignocellulose-containing material for providing a pulp of both high strength and brightness. Increase in strength is provided in the first stage by hyper-alkaline peroxide bleaching pH of over 12. The desired brightness increase is provided in a subsequent stage with or without intermediate washing of the pulp at a lower initial pH.

U.S. Pat. No. 4,756,798 to Lachenal et al. teaches the concept of adding oxygen during the hydrogen peroxide bleaching of mechanical pulp. The bleaching liquid that is disclosed in this patent includes alkaline hydrogen peroxide with sodium silicate and magnesium sulphate.

U.S. Pat. No. 4,898,642 to Moore et al. is directed to twisted, chemically stiffened cellulosic fibers and absorbent structures made therefrom. According to the '642 patent curled cellulosic fibers are chemically stiffened with a cross linking agent which is typically a $C_2$-$C_8$ dialdehyde.

U.S. Pat. No. 4,915,785 to Siminoski et al. discloses a single stage process for bleaching pulp with an aqueous hydrogen peroxide bleaching composition containing magnesium sulphate and sodium silicate.

There is disclosed in U.S. Pat. No. 4,938,842 to Whiting a bleaching liquid composition including hydrogen or sodium peroxide, sodium hydroxide, sodium silicate, magnesium sulphate and a chelating agent.

U.S. Pat. No. 4,976,819 to Minton discloses a method for treating pulp prior to forming a web. The method includes mechanical treatment of a pulp slurry of up to 50% consistency by dewatering and compacting the pulp. The pulp is twisted and kinked such that a web of enhanced softness is provided. The preferred device for imparting such twisting and kinking, is a plug screw feeder. Pulp that has been so treated exhibits increased drainability in a wet section of a paper machine.

U.S. Pat. No. 5,211,809 to Naddeo et al. discloses a color removal process for secondary (recycle) fiber. Color from dyes is removed from secondary pulps with non-chlorine based bleaching agents in treating sequences using oxygen with combinations of peroxide, ozone and/or hydrosulfite, at controlled pH conditions (less than 8 or greater than 10). Acid treatment prior to bleaching improves color removal and protects fibers from damage at more severe bleaching conditions.

There is disclosed in U.S. Pat. No. 5,244,541 to Minton a pulp treatment method wherein mechanically refined pulp is kinked and twisted and subsequently subjected to papermaking process steps.

U.S. Pat. No. 5,296,100 to Devic relates to hydrogen peroxide/alkaline bleaching of wood pulps. High-yield ligno-cellulosic wood pulps are bleached by pre-treating the pulp with a complexing agent and washing the pre-treated pulp followed by bleaching the pulp with hydrogen peroxide in an alkaline medium. When from about 60 per cent to 85 per cent of the initial amount of hydrogen peroxide has been consumed, a supplementary amount of hydrogen peroxide being equal to or less than the initial amount is added.

European Publication No. 0 440 472 reports high bulking resilient fibers produced by crosslinking wood pulp fibers with polycarboxylic acids such as citric acid.

U.S. Pat. Nos. 5,384,011 and 5,384,012 to Hazard et al. disclose a process for preparing individual crosslinked cellulosic fibers wherein curing and drying are carried out in separate stages. The drying and curing steps are carried out in turbulent pressurized superheated steam.

U.S. Pat. No. 5,501,768 to Hermans et al. is directed to a method of treating papermaking fibers for making tissue. According to the '768 patent, the throughdryability of dewatered, but wet, sheets made from papermaking fibers can be significantly increased by subjecting an aqueous suspension of the fibers at high consistency to elevated temperatures with sufficient working of the fibers. It is noted in Col. 3, lines 36 and following that the temperatures can be about 150° F or greater. It is further noted that mechanical treatment with equipment having relatively high volume to working surface areas, such as dispargers are preferred and that disk refiners, for example, are not preferred. See Col. 3, line 65 to Col. 4, line 13. Power inputs are greater than 1 HP day/ton. Note examples 1-11. See, also, U.S. Pat. No. 5,348,620.

U.S. Pat. No. 5,571,377 to Tibbling et al. describes a process for peroxide bleaching of chemical pulp in a pressurized bleach vessel. Suspension of pulp having a concentration preferably exceeding 8 per cent of cellulose containing fiber material is continuously fed to a bleaching vessel and treated with an acid to adjust the pH value below 7 and is subsequently bleached in a bleaching stage to a brightness exceeding 75 per cent ISO. Peroxide bleaching takes place at elevated temperature and that the pressure in a bleaching vessel which exceeds two bar and where the cross section of the area the bleaching vessels exceeds 3 square meters.

U.S. Pat. No. 5,755,926 of Hankins et al. is directed to an integrating pulping process for recycling waste paper. The method and system includes a mild alkaline pulping process with oxygen and hydrogen peroxide followed by rapid decompression of fibers and hot washing.

U.S. Pat. No. 5,772,845 to Farrington Jr. et al. is directed to a method of making tissue, without the use of a Yankee dryer. The typical Yankee functions of building machine direction and cross direction stretch are replaced by a wet end rush transfer and the throughdrying fabric design, respectively. The products are preferably made with chemimechanically treated fibers in at least one layer. It is noted in the '845 patent that certain methods can introduce curl, kinks and microcompressions into the fiber which decrease fiber to fiber bonding, decrease sheet tensile strength, and increase sheet bulk, stretch, porosity, and softness. Examples of mechanical treatments include flash drying, dry fiberizing and wet high consistency curling. A preferred method for modifying the fibers is taught to be through the use of a shaft disperser. See Col. 5.

U.S. Pat. No. 5,834,095 to Dutkiewicz et al. discloses a treatment process for cellulosic fibers. The process includes treating cellulosic fibers using high temperatures that are effective to result in modifications to the fiber. The fibers are typically heat treated with hot air. Also provided is a cross-linking catalyst to facilitate fiber modification. See Col. 4, lines 1-10.

U.S. Pat. No. 5,858,021 to Sun et al. discloses a treatment process for cellulosic fibers. The process first prepares the cellulosic fibers in a high consistency mixture with water and then adds an alkaline metal hydroxide. The high consistency process has been found to produce cellulosic fibers that are uniformly treated. In the '021 patent a high energy disperser such as a twin screw disperser, is utilized. Typical conditions for using the disperser include an energy level of about 6 horsepower-day per ton of cellulosic fiber and a feed rate of cellulosic fiber of about 2000 pounds per hour. See Col. 10, lines 13-40.

U.S. Pat. No. 5,997,689 to Bokstrom discloses a method of bleaching secondary fibers. A secondary fiber pulp is first slushed and then transferred at a consistency of 20-40 percent to a disperser wherein the pulp is mechanically treated and treated with oxygen. The pulp is thereafter conveyed to a bleaching tower wherein it is treated with alkali and hydrogen peroxide.

United States Statutory Invention Registration No. H1704 of Wallajapet et al. is directed to a modified cellulose fiber having improved curl. This statutory invention registration describes an oxidized or sulfonated cellulose fiber having a curled, stable structure. The oxidized or sulfonated curled fiber is prepared by a process including treating the fibers in a high energy refiner effective to provide the desired curl properties to the fiber which is used in disposable absorbent products. Typically, the high energy disperser employed is a twin screw disperser. See Col. 8, lines 10-35.

International Publication WO 98/27269 of Kimberly Clark Worldwide, Inc. discloses a process for treating cellulosic fibers using steam explosion that is reported to result in modified cellulosic fibers that exhibit desired properties such as wet curl properties. Aqueous pulp having consistencies of from 25 to 75 percent are contacted with steam from 2-6 minutes and then explosively decompressed. Curl indices of from about 0.2 to about 0.3 are attained. See Example 1 and Table 1.

SUMMARY OF THE INVENTION

There is provided in a first aspect of the present invention a process for producing high bulk cellulosic fiber exhibiting a durable elevated curl index including the steps of: (a) concurrently heat-treating, bleaching and convolving cellulosic fiber pulp at elevated temperature and pressure at high consistency in a bleaching liquor, preferably under conditions selected so as to preclude substantial fibrillation and attendant paper strength and fiber bonding development and (b) recovering the pulp wherein the length weighted curl index of the treated fiber is at least about 20% higher than the length weighted curl index of the fiber prior to the heat treatment and convolving thereof. Typically, at least about 20% elevation of the length weighted curl index of the treated fiber persists upon treatment for 30 minutes in a disintegrator at 1% consistency at a temperature of 125° F. As will further be discussed below, the laboratory disintegrator is suitably operated at 3000 rpm and is of the type described in TAPPI Standard T205 Sp-95.

BRIEF DESCRIPTION OF DRAWINGS

The invention is described in detail below in connection with the various Figures. In the Figures.

DETAILED DESCRIPTION

Figure 1:
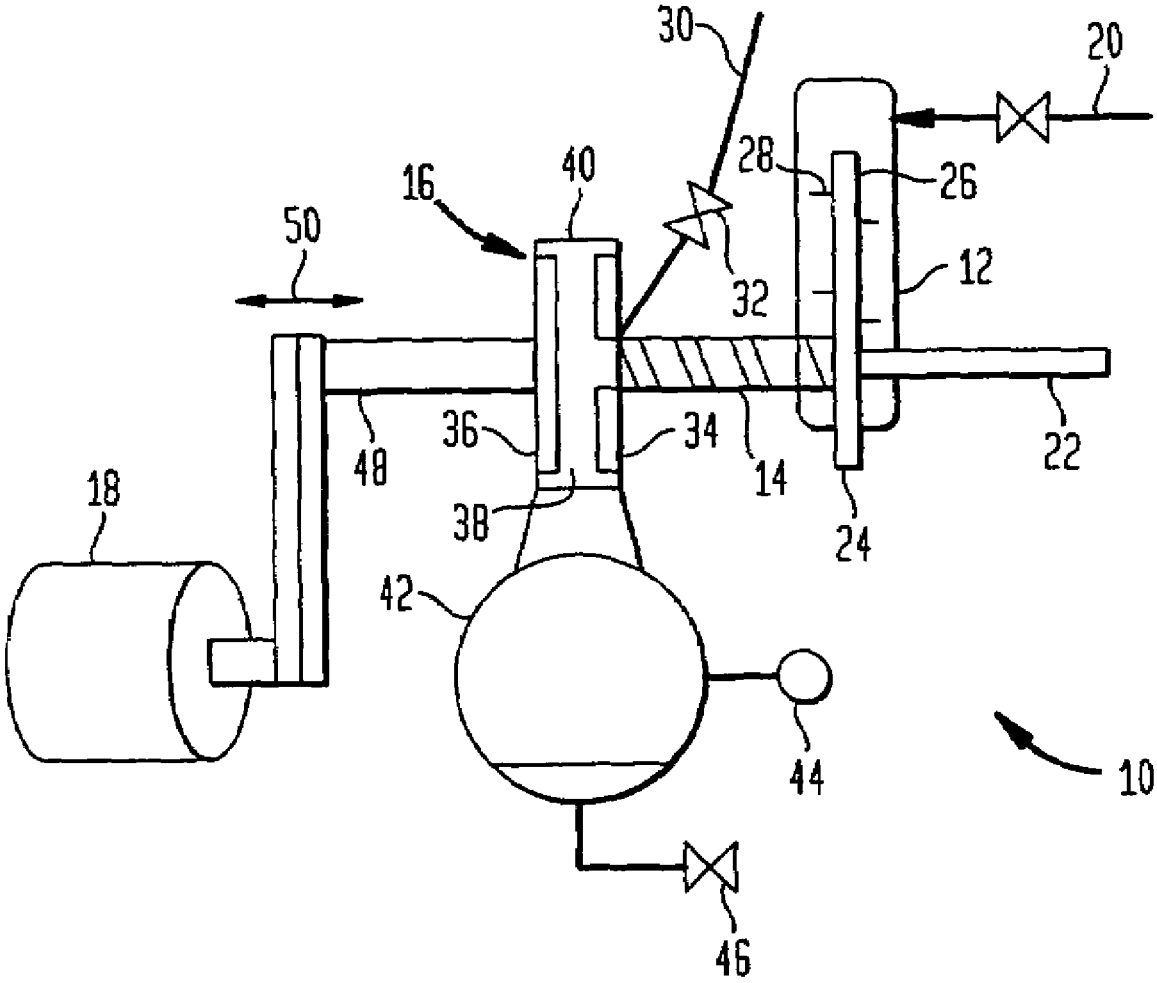
FIG. 1 is a schematic diagram of a disk refining apparatus which may be utilized in accordance with the present invention.

The present invention is described in connection with numerous examples and figures which form a part of this detailed description. Such exemplification and illustration of the invention is provided for purposes of explanation only. Modifications within the spirit and scope of the present invention, set forth in the appended claims, will be readily apparent by those of skill in the art. The present invention is generally directed to a process for bleaching cellulosic fiber which then exhibits a durable elevated curl index. The process is typically carried out with a bleaching liquor in a chamber in the presence of saturated steam. Most preferably, the pressure in the chamber is pulsed with respect to time either on a macroscopic level or by way of localized pressure pulsations. One may introduce such localized pressure pulsations by carrying out the inventive process in a rotating disk refiner having one or more disk relief patterns operative to impart localized pressure pulses within the chamber. When using a disk refiner the gap between a rotating disk and an opposing surface is generally from about 0.5 mm to about 10 mm, with from about 1 mm to about 5 mm being more typical.

In most cases, the step of concurrently bleaching, heat treating and convolving the fiber in a process in accordance with the present invention includes applying mechanical shear to the fiber at relatively high consistency. Generally, pulp which is processed in accordance with the present invention exhibits a drop in CSF (freeness) of at most about 60 ml. Less than about 45 ml is more typical with less than about 30 ml being preferred. CSF is determined in accordance with TAPPI Standard T 227 OM-94 (Canadian Standard Method).

In many embodiments, the curl index of the treated fiber is at least about 30% higher than the curl index of the fiber prior to the step of concurrently heat treating and convolving the fiber. It is preferred that the curl index of the treated fiber is durable enough so that it is reduced by at most about 25% by treatment at 1% consistency at 125° F. in a disintegrator for 30 minutes. More preferably, the length weighted curl index of the treated fiber is reduced by at most about 15% by treatment at 1% consistency at 125° F. in a disintegrator for 30 minutes.

In particularly preferred embodiments of the present invention, the curl index of the treated fiber is at least about 40% higher than the curl index of the fiber prior to heat treating and convolving the fiber in accordance with the present invention. Still more preferably the treated fiber has a length weighted curl index of at least about 50% higher than the curl index of the fiber prior to treatment.

The curl index attained by way of practicing the present invention will to some extent depend upon the curl index of the fiber prior to treatment. In most cases, the treated fiber has a length weighted curl index of at least about 0.12. More preferably the curled fiber has a length weighted curl index of at least about 0.15 with minimum values of at least about 0.2, 0.25 or 0.3 being particularly preferred. Generally, the length weighed curl index is determined by standard procedure in an Op Test fiber analyzer, model number Code LDA 96 in accordance with the equations set forth hereinafter.

The heat treatment and convolving of the fiber or pulp in accordance with the present invention is generally carried out at a consistency of from about 20% to about 60% with from about 20% to about 50% being typical and from about 30% to about 40% being preferred.

Quite remarkably, the bleaching, heat treating and convolving of the fiber is carried out with very short residence times in a disk refiner, for example, involving a duration of from about 0.01 to about 20 seconds. Typically, the step of heat treating and convolving the fiber has a duration of less than about 10 seconds with less than about 5 seconds, and indeed, less than about 2 seconds being typically suitable.

Heat treatment and curling of the fiber is generally carried out a temperature of from about 230° F. to about 370° F. and typically with relatively low power inputs. Mechanical power inputs of less than about 2 HP day/ton, more preferably less than about 1 HP day/ton, and even more preferably at mechanical energy inputs less than about 0.5 HP day/ton are suitable. Higher energy inputs may be suitable under some conditions. For example, provided the equipment is suitable and the fiber is not subject to undue degradation one may utilize more than about 5 HP day/ton up to about 10, 15, 20 or even 25 HP day/ton if the material will not develop substantial paper strength and fiber bonding by way of such treatment.

In general, the process is carried out in saturated steam at a pressure of from about 5 to about 150 psig, with perhaps from about 10 to about 90 psig being more typical.

When the pulp is heat treated and curled, papermaking chemicals for example sulfates, silicates, hydroxides, peroxides and debonders may be added if so desired. In a particularly preferred aspect of the invention, the fiber is heat treated and curled in the presence of an alkaline agent and a peroxide bleach.

In many instances the fiber will include secondary (recycled) fiber. In still other embodiments the fiber will consist essentially of secondary fiber or may be a mixture of virgin fiber and secondary fiber including from about 5 to about 95% by weight of secondary fiber based on the weight of fiber present in the pulp. In other instances, the fiber will be 100% recycle or secondary fiber. The present invention may be applied to any suitable pulp including Kraft hardwood fibers, Kraft softwood fibers, sulfite hardwood fibers, sulfite softwood fibers, and mixtures thereof. So also, the fibers may be mechanically pulped fibers, chemi-mechanically pulped fibers and mixtures thereof.

In another aspect of the invention, there is provided a method for producing a bleached, high bulk cellulosic fiber exhibiting a durable elevated curl index comprising: (a) concurrently heat-treating and convolving a cellulosic fiber at high consistency with a peroxide bleaching liquor comprising a peroxide component wherein the step is carried out at elevated temperature and pressure and (b) recovering the fiber wherein the curl index of the treated fiber is at least about 20% higher than the curl index of the fiber prior to non-destructive refining and the elevation of the curl index so attained persists for at least 30 minutes at about 125° F. at low consistency. Generally, the peroxide component comprises hydrogen peroxide; however, the peroxide component may be selected from the group consisting of sodium peroxide, potassium peroxide and mixtures thereof. The bleaching liquor may further comprise an alkaline agent such as sodium hydroxide and a peroxide stabilizer. Generally, such stabilizers are silicates, typically sodium silicate.

The bleaching liquor may further comprise a sequestering agent, such as diethyltriaminopentacetic acid.

During the process, generally about 4.5 to about 6 wt. % of peroxide compound is consumed per pound of dry pulp. The process may be carried out in the presence of oxygen. The inventive process may further include the step of subjecting the bleached and curled fiber to a reductive bleaching process, such as hydrosulphite bleaching process.

In still yet another aspect of the present invention there is provided a process for producing a bleached, high bulk cellulosic fiber exhibiting a durable elevated curl index comprising: (a) subjecting a cellulosic fiber to high consistency heat-treating and convolving with a bleaching liquor selected from the group consisting of hydrosulphite bleaching liquors and peroxyacid bleaching liquors wherein the heat treatment and convolving step is carried out at elevated temperature and pressure and (b) recovering said fiber wherein the curl index of the treated fiber is at least about 20% higher than the curl index of the fiber prior to treatment and the elevation of the curl index so attained persists for at least 30 minutes at about 125° F. at low consistency. In some embodiments, the bleaching liquor comprises peroxyacetic acid and in others peroxymonosulfuric acid.

Processing in accordance with the present invention induces a significant amount of curl and kink to papermaking fibers which results in increased caliper and sheet void volume, with reduced strength; all beneficial to tissue and towel production. The process will also increase sheet air porosity, increasing the suitability of the processed fibers for manufacturing paper on a machine employing throughair dyers. The fibers can also be incorporated into any paper sheet where increased bulk is beneficial.

Fibers suitable for treatment by the process include virgin kraft hardwood and softwood, mechanical and chemi-mechanical pulps, and secondary fibers.

Process steps may, in some exemplary embodiments include (1) thickening a slurry of papermaking fibers to about 35% consistency, (2) feeding the fibers into a sealed pressure vessel tube, (3) heating the fibers to a saturated steam pressure between 5 PSIG and 150 PSIG, (4) feeding the fibers through a disk refiner or similar machine to impart mechanical action to the fibers with a specific energy application of less than 1 to 2 HP day/ton, (5) discharging the fibers from the pressurized system by a blow valve or similar discharge device, (6) supplying the fibers to a papermaking process. Papermaking fibers from pulping or paper recycling operations are typically supplied to the process thickening device. Such devices include twin wire presses and screw type presses. The fiber stream is thickened from an inlet consistency of about 5%, or lower, to 20% to 50% solids. Normally a 35% solids level can be easily achieved with normal or light duty presses. A particular advantage of this process is the ability to utilize pulps at a 35% or lower consistency. Increasing the consistency to about 50% requires about 2 to 3 times the pressing energy required at 35% consistency. To achieve consistency much above 50% requires the application of thermal drying energy which greatly increases the operating cost. The utilization of about 35% solids pulp results in both a lower capital cost for the pressing equipment and a lower operating cost compared to other processes requiring higher levels of dryness. The pulp discharged from the pressing device is fed into a pressurized heating or steaming chamber or tube. Common devices include positive displacement pumps and plug screw feeders. The chamber is pressurized with saturated steam to a pressure of 5 PSIG to 150 PSIG. The pulp is fed through the chamber and is heated to saturated temperature by the steam. Alternately the pulp could be heated by other means including non contact steam and electrical heaters.

The pulp is then fed into a high consistency disk refiner. The disk refiner plate pattern, plate gap and throughput is adjusted to provide a low specific energy to the pulp, most preferably below 1 to 2 HP day/short ton. The refining conditions are selected to minimize refiner plate to fiber impacts of a high energy nature which result in fiber fibrillation and cutting or strength development. The fiber is then discharged out of the refiner through several commercially available means including but not limited to a blow valve and cyclone arrangement. The steam exiting the cyclone can be recovered for its heat value further reducing the operating cost of the system. The curled and kinked discharged pulp can then be held at discharge solids level of about 25% to 50% or can be diluted to 5% or less solids level. The pulp can be held in storage tanks for extended periods or be supplied directly to the papermaking process. A significant advantage of this process is the resiliency or permanency of the curled nature of the pulp which greatly simplifies the system to deliver the pulp to the papermaking process.

Thus, the concurrent heat and mechanical treatment of the present invention is advantageously carried out in a disk refiner apparatus at elevated temperature and pressure wherein the surface patterns of the disk or disks produce localized compressive/decompressive shear conditions in a pulsating manner over time. Generally speaking, the fibers are heat and mechanically treated to increase curl by mechanically convolving the fibers at elevated temperature and pressure under relatively low mechanical energy input. Conditions are often selected so as to preclude substantial fibrillation and attendant strength and bonding development, while also preventing substantial fiber damage or scorching. In a preferred embodiment, the curl index is increased without unduly reducing the freeness of the pulp. A particularly preferred mode of practicing the present invention also involves concurrently heat-treating and convolving the fiber at a temperature of at least about 230° F. in a disk refiner at a very low specific energy input. The energy input may in fact be less than that required to operate the refiner without pulp or may be from about a finite value to less than about 2 HP day/ton. The lower limit of specific energy input required to practice the present invention may be difficult to determine, or may even be a negative value with respect to a reference value. Specific energy inputs of from about 0.01 HP day/ton up to about 2 HP day/ton are believed suitable. Preferably, the mechanical energy employed is thus specified as less than an upper limit at which the refiner tends to fibrillate the fiber and to reduce the effectiveness of the process in imparting permanent curl to the treated fiber.

The duration of the step of convolving and heat-treating the fiber in a disk refiner is calculated as the volume of the refining cavity (that is, the cylindrical cavity between disks) times the reciprocal of the volumetric flow rate of the pulp based on its substantially uncompressed volume after the curling step. The duration of the curling and bleaching step is sometimes referred herein as residence time in the refiner.

In most cases, the step of concurrently heat treating and convolving the fiber in a process in accordance with the present invention includes applying mechanical shear to the fiber at relatively high consistency. As noted above, generally pulp which is processed in accordance with the present invention exhibits a drop in CSF (freeness) of at most about 60 ml. Less than about 45 ml is more typical with less than about 30 ml being preferred. In some embodiments, the pulp exhibits a drop in CSF of at most about 20 ml, preferably at most about 10 ml. More preferably, the pulp exhibits no drop in CSF and optionally exhibits an increase of at least 10 ml. CSF increases of 20 ml, 30 ml and more can be attained by way of the inventive process.

CSF is determined in accordance with TAPPI Standard T 227 OM-94 (Canadian Standard Method). The porofil or "void volume", as referred to hereafter, is determined by saturating a sheet with a nonpolar liquid and measuring the amount of liquid absorbed. The volume of liquid absorbed is equivalent to the void volume within the sheet structure. Porofil is expressed as grams of liquid absorbed per gram of fiber in the sheet structure. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.001 gram. Place the specimen in a dish containing POROFIL™ liquid, having a specific gravity of 1.875 grams per cubic centimeter, available from Coulter Electronics Ltd., Northwell Drive, Luton, Beds, England; Part No. 9902458.) After 10 seconds, grasp the specimen at the very edge (1-2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Ltd., Maidstone, England) in order to remove any excess of the last partial drop. Immediately weigh the specimen, within 10 seconds, recording the weight to the nearest 0.001 gram. The void volume for each specimen, expressed as grams of POROFIL per gram of fiber, is calculated as follows:

$$\text{void volume}=[W_2-W_1)/W_1],$$

wherein

"W1" is the dry weight of the specimen, in grams; and

"W2" is the wet weight of the specimen, in grams.

The porofil or void volume for all eight individual specimens is determined as described above and the average of the eight specimens is the void volume for the sample.

Unless otherwise stated, breaking length and stretch are reported hereinafter in accordance with standard Tappi T 494 OM-96 procedures.

The curl generated can be quantified by several means. Unless otherwise specified, the OpTest Fiber Quality Analyzer (FQA) from OpTest Equipment, Hawkesbury, Ontario, Canada, Model No. Code LDA 96, was utilized to determine fiber length and curl indices. The analyzer is operated at standard settings, that is, the settings are for fibers 0.5 mm and longer with curl indices from 0 to 5. The FQA measures individual fiber contour and projected lengths by optically imaging fibers with a CCD camera and polarized infrared light. The arithmetic curl index, CI, is determined by:

$$CI = \frac{L}{l} - l$$

L=contour length l=projected length

The length weighted curl index, $CI_{LW}$, is calculated by multiplying the sum of the individual CI by its contour length and dividing by the summation of the contour lengths:

$$CI_{LW} = \frac{\sum CI_i L_i}{\sum L_i}$$

$CI_i$=individual arithmetic curl index $L_i$=individual contour length

Length weighted mean curl indices typically between 0.100 and 0.260 have been generated in the process.

Length weighted mean curl indices up to about 0.35 have been generated.

Unless otherwise indicated, "Curl Index", "Mean Curl" and like terminology as used herein refers to length weighted curl index of the pulp. In order to determine curl durability, fiber curled in accordance with the present invention is treated in a laboratory disintegrator (of the type specified in TAPPI Standard T205 Sp-95) for 30 minutes at 1 percent consistency. Such equipment is available from Testing Machines Inc., Amityville, N.Y. and is suitably operated at 3,000 rpm and 125° F. for the test procedure. Other temperatures and speeds may be used if so desired to test the suitability of the fiber for an application.

Figure 5:
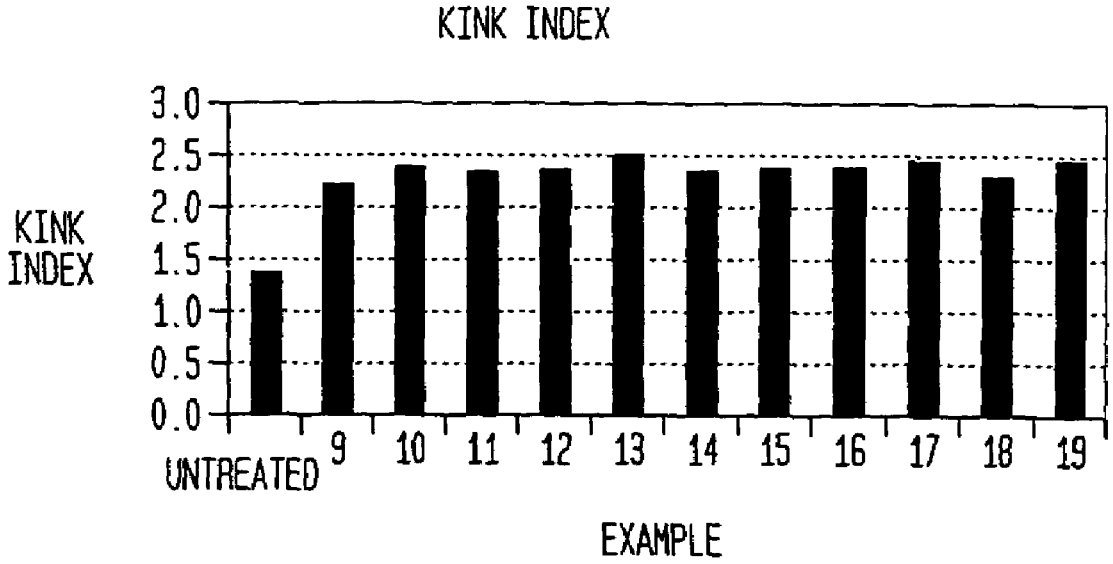

FIG. 5 is a histogram of individual fiber kink index for fibers treated in accordance with the invention. The FQA kink index, derived from the Kibblewhite kink index, is a weighted sum of the distinct angles or discontinuities in each fiber divided by the fiber contour length:

$$\text{Kink index} = \frac{2N_{21°-45°} + 3N_{46°-90°} + 4N_{91°-180°}}{L}$$

Where $N_{a-b}$ represents the number of kinks in an individual fiber which have a change in fiber direction between a and b degrees. Thus, for a 1 mm fiber a kink index of 2.0 $mm^{-1}$ would correspond to only one small-angle kink. The refiner curling process shifts the distribution toward higher kink index; however, very few fibers have a kink index above about four.

High energy refining of wood chips to produce "mechanical" pulps is practiced in many pulp mills. It is well known that a temporary curl, known as latency, is generated in the fibers after the refining process. The curl will relax after a short time generally 20 to 60 minutes. Common practice in mechanical pulp mills is to install a "latency chest" after the refiners to allow time for the curl to fully relax. These mills also perform a laboratory latency removal treatment to the pulp prior to testing the properties of the fibers. Industry standard methods include TAPPI 262, CPPA C.8P, and SCAN-M 10:77. All of these methods involve a hot disintegration for about 1 to 2 minutes. Based on the standard methods a hot disintegration process was developed to determine the permanency of the curl generated by the curling process of the present invention. The method utilizes a lower temperature and a much longer disintegration than standard to more closely mimic paper mill conditions. Samples of secondary pulp curled in accordance with the present invention were disintegrated in the British standard laboratory disintegrator for 30 minutes (3,000 rpm) at about 125° F. and 1% consistency.

A series of runs were carried out in a 12" Sprout Waldron batch refining system, a schematic diagram of which is shown in FIG. 1, utilizing chemicals including hydrogen peroxide as a bleaching agent and sodium hydroxide as an alkaline agent. FIG. 1 depicts a batch refining apparatus 10 which includes generally a steaming chamber 12, a feed screw 14, a disk refining portion 16, a drive motor 18 and a steam supply 20. In the apparatus employed Steaming Chamber 12 included a vertical tube with a bolt on cover. The chamber is equipped with a mixer rake 24 provided with a shaft 26 and blades 28 to agitate the pulp and help facilitate heating. During operation steam is fed into the chamber via steam supply 20 to heat the pulp and pressurize the system. The steam pressure is monitored and controlled by a pressure indicator 44 and an appropriate control loop. The pulp was steamed for 5 to 15 minutes for most experiments described hereinafter. Variable speed feed screw 14—a tube with a internal screw connects the steaming chamber to refiner portion 16 including a case 40 as well as a stator 34 and a rotor 36 defining a refining gap 38 therebetween. The bottom of the steaming chamber opens directly to the screw. A variable speed drive indicated generally at 22 connects to screw 14 and is used to move the pulp from the bottom of the steaming chamber into the refiner case. The speed of the screw was adjusted to provide about 5 seconds of residence time in the feed screw.

Stator 34 has a hole in the center through which feed screw 14 pushes the pulp into refiner plate gap 38. Opposite the stator is rotor 36 which is coupled to the drive motor via a shaft 48 and drive belts. The rotor assembly can be moved in and out to adjust the gap between the stator and rotor as is indicated schematically at 50. Standard 12" diameter, 6 segment refiner plates are bolted onto the rotor and stator. The case also has a chemical inlet pipe 30 equipped with a valve 32 to supply chemicals such as bleaching chemicals, discussed hereinafter in more detail, just at the point the pulp enters the hole in the stator. During the bleaching experiments the chemical charge was metered into the chemical inlet at a rate and concentration calculated to match the pulp feed rate at the desired chemical application. The pulp is mechanically treated between the rotor and stator plates and is thrown out into the refiner case. The rotor assembly can be moved in and out to adjust the gap between rotor and stator plates 36, 34. The bottom of the refiner case is open to a pulp receiver vessel 42. Total residence time of the pulp in the case is estimated to be less than 0.2 seconds. The pulp falls out of the refiner case by gravity and into receiver 42. The receiver is a horizontal tank equipped with a bolt on cover. At the bottom of the receiver is a screened tray designed to catch the pulp and to prevent the pulp from plugging a depressurization valve 46. During operation the receiver is maintained at system pressure. For most experiments the pulp was held in receiver 42 for 1 to 2 minutes of refiner operation plus an additional 0 to 10 minutes residence time at pressure without refiner operation. The depressurization valve is normally left slightly open during the experiments to 1) evacuate air in the system (which would prevent sufficient steam flow to heat the pulp), and 2) to drain any steam condensate from the refiner system. The valve was also used to depressurize the system at the end of the experiment. The main steam supply valve of supply 20 was closed and the vent valve opened 25 to 50%. At this opening the steam pressure was relieved over 1 to 2 minutes.

Results appear below.

EXAMPLES 1-8

Approximately 100 lb of finished pulp was transported at about 5% consistency and thickened to 35% consistency. These runs were exploratory in nature and dealt primarily with developing operating parameters for the unit. It was noted that significant curl was imparted to the fiber during very low power application bleaching. A large plate gap was used to minimize refining. This work was performed with a hydrogen peroxide based bleaching liquor.

EXAMPLES 9-25

A sample of paper was acquired for the next set of tests. The paper was wetted to 35% consistency and run through a lab pilot pulp breaker before use in the refiner. Runs 9 to 19 and the production runs of Examples 20-25 performed with this sample. During these runs it was discovered that the measured curl in the fiber was related to the bleaching performance in the refiner. Again, these runs were performed with a large gap and low power application in the refiner. The positive impact of bleaching in the refiner on curl was carried through subsequent hydrosulfite bleaching and a variety of retention conditions. The examples demonstrated that a significant amount of the curl was preserved through the storage and repulping/paper making process. This curl generated a tissue sheet of increased caliper and Porofil while reducing the tensile strength.

EXAMPLES 26-35

Runs 26-35 were performed with BCTMP and virgin hardwood and softwood. All of these runs, except one, were performed without chemicals. The curl response of the pulps varied somewhat; the Western pulp having little curl induced while the Softwood has a high induced curl.

Results of the bleaching trials appears in Tables 1 through 8 below. Weight %, or % OP is expressed as a percentage of dry pulp unless otherwise indicated. In Tables 1-8 "run time" refers to the length of time a batch of material is fed to the refining portion of the apparatus of FIG. 1; whereas "residence time" refers to the length of time a batch is maintained in vessel 42 at temperature and pressure. "Hydrosulfite" GE Brightness and like terminology refers to Brightness for examples where the pulp was bleached and curled in accordance with the present invention and then hydrosulfite bleached by conventional means.

TABLE 1

Examples 1-8 Operating Conditions and Refiner Operation

| Example | Brightness GE | Cons % | Pulp Flow kg/min | Run Time Min | Steam PSIG | Temp ° F. | Residence Min |
|---|---|---|---|---|---|---|---|
| 1 | 37.5 | 35 | 0.5 | 3 | 15 | 250 | 10 |
| 2 | 37.5 | 35 | 0.5 | 3 | 15 | 250 | 10 |
| 3 | 37.5 | 35 | 0.5 | 3 | 15 | 250 | 20 |
| 4 | 37.5 | 35 | 0.5 | 3 | 20 | 270 | 0 |
| 5 | 37.5 | 35 | 0.5 | 3 | 15 | 250 | 10 |
| 6 | 37.5 | 35 | 0.5 | 3 | 15 | 250 | 5 |
| 7 | 37.5 | 35 | 0.5 | 3 | 15 | 250 | 5 |
| 8 | 37.5 | 35 | 0.5 | 3 | 15 | 250 | 0 |

TABLE 1-continued

| Refiner Chemicals & Results | | | | | | | | |
|---|---|---|---|---|---|---|---|---|
| Example | Mag Sulfate g/l | DTPA % OP | Silicate % OP | Caustic % OP | Peroxide % OP | Brightness GE | ResH2O2 % OP | Hydrosulfite Brightness GE |
| 1 | 0.25 | 0.25 | 0.5 | 2 | 5 | | 0 | |
| 2 | 0.2 | 0.25 | 0.5 | 1 | 4 | 41.6 | 0 | |
| 3 | 0.1 | 0.4 | 0.5 | 1 | 5 | 44.0 | | |
| 4 | 0 | 0.25 | 0.2 | 1 | 5 | 41.1 | | |
| 5 | 0 | 0 | 0 | 0 | 0 | 35.1 | | |
| 6 | 1 | 0.25 | 0 | 1 | 5 | 41.6 | 0 | |
| 7 | 0.5 | 0.25 | 0.1 | 1 | 5 | 44.2 | 0.72 | |
| 8 | 0.5 | 0.25 | 0.5 | 1 | 6 | 48.3 | 1.8 | 51.3 |

TABLE 2

| Examples 1-8 Pulp Fiber Analysis Results | | | | | | | | | |
|---|---|---|---|---|---|---|---|---|---|
| | | Percent Fines | | Mean Length mm | | | Mean Curl | | |
| Example | Retention Hours | Arithmetic | Length Weighted | Arithmetic | Length Weighted | Weight Weighted | Arithmetic | Length Weighted | Kink Index |
| Base | 0 | 42.15 | 8.88 | 0.529 | 1.336 | 2.308 | 0.07 | 0.073 | 1.27 |
| 1 | 0 | 59.05 | 24.39 | 0.292 | 0.631 | 1.151 | 0.115 | 0.126 | 1.91 |
| 2 | 0 | 45.65 | 11.02 | 0.477 | 1.282 | 2.284 | 0.161 | 0.177 | 2.31 |
| 3 | 18 Min | 48.62 | 13.27 | 0.421 | 1.105 | 2.033 | 0.152 | 0.177 | 2.11 |
| 3 | 12 | 46.7 | 11.58 | 0.457 | 1.194 | 2.115 | 0.162 | 0.174 | 2.21 |
| 3 | 12 | 46.7 | 11.58 | 0.457 | 1.194 | 2.115 | 0.162 | 0.174 | 2.21 |
| 4 | 0 | 47.98 | 12.01 | 0.451 | 1.214 | 2.192 | 0.143 | 0.156 | 2.08 |
| 4 | 72 | 45.65 | 10.56 | 0.485 | 1.313 | 2.371 | 0.121 | 0.138 | 1.83 |
| 5 | 0 | 48.5 | 12.81 | 0.432 | 1.19 | 2.198 | 0.163 | 0.181 | 2.16 |
| 5 | 18 | 46.5 | 11.98 | 0.443 | 1.161 | 2.109 | 0.164 | 0.181 | 2.24 |
| 6 | 0 | 47.7 | 12.46 | 0.447 | 1.188 | 2.118 | 0.164 | 0.188 | 2.21 |
| 6 | 24 | 46.77 | 12.09 | 0.44 | 1.135 | 2.007 | 0.152 | 0.165 | 2.13 |
| 7 | 0 | 45.88 | 11.5 | 0.459 | 1.196 | 2.128 | 0.161 | 0.179 | 2.13 |
| 7 | | 47.08 | 12 | 0.446 | 1.16 | 2.076 | 0.161 | 1.072 | 2.16 |
| 8 | 0 | 46.2 | 11.42 | .0466 | 1.239 | 2.229 | 0.151 | 0.169 | 2.06 |
| 8 | | 43.58 | 9.9 | 0.498 | 1.297 | 2.258 | 0.142 | 0.153 | 2.11 |
| 8 | 0 | | | | | | | | |
| 8 | 0 | | | | | | | | |
| 8 | 0 | | | | | | | | |

TABLE 3

| Examples 9-25 Operating Conditions | | | | | | | |
|---|---|---|---|---|---|---|---|
| Example | Brightness GE | Cons % | Pulp Flow kg/min | Run Time Min | Steam PSIG | Temp ° F. | Residence Min |
| 9 | 48.8 | 35 | 0.5 | 3 | 15 | 250 | 5 |
| 10 | 48.8 | 35 | 0.5 | 3 | 15 | 250 | 5 |
| 11 | 48.8 | 35 | 0.5 | 3 | 15 | 250 | 5 |
| 12 | 48.8 | 35 | 0.5 | 3 | 15 | 250 | 5 |
| 13 | 48.8 | 35 | 0.5 | 3 | 15 | 250 | 5 |
| 14 | 48.8 | 35 | 0.5 | 3 | 15 | 250 | 5 |
| 15 | 48.8 | 35 | 0.5 | 3 | 25 | 270 | 5 |
| 16 | 48.8 | 35 | 0.5 | 3 | 25 | 270 | 5 |
| 17 | 48.8 | 35 | 0.5 | 3 | 25 | 270 | 5 |
| 18 | 48.8 | 35 | 0.5 | 3 | 25 | 270 | 5 |
| 19 | 48.8 | 35 | 0.5 | 3 | 25 | 270 | 5 |
| 20 | 48.8 | 35 | 0.5 | 3 | 25 | 270 | 5 |
| 21 | 48.8 | 35 | 0.5 | 6 | 15 | 250 | 5 |
| 22 | 48.8 | 35 | 0.5 | 6 | 15 | 250 | 5 |
| 23 | 48.8 | 35 | 0.5 | 6 | 15 | 250 | 5 |
| 24 | 48.8 | 35 | 0.5 | 6 | 15 | 250 | 5 |
| 25 | 48.8 | 35 | 0.5 | 6 | 15 | 250 | 5 |

TABLE 3-continued

Refiner Chemicals & Results

| Example | Magnesium Sulfate g/l | DTPA DTPA % OP | Sodium Silicate % OP | Caustic Caustic % OP | Peroxide % OP | Brightness GE | Res H2O2 % OP | Res NaOH % OP | Hydrosulfite Brightness GE |
|---|---|---|---|---|---|---|---|---|---|
| 9 | 0.2 | 0.2 | 0.5 | 0.5 | 5 | 57.4 | 1.05 | 1.3 | |
| 10 | 0.2 | 0.2 | 0.5 | 0.75 | 5 | 59 | 0.55 | 1.3 | |
| 11 | 0.2 | 0.2 | 0.5 | 1 | 5 | 58.1 | 0.32 | 1.13 | 65.1 |
| 12 | 0.2 | 0.2 | 0.5 | 1.25 | 5 | 58.4 | 0.15 | 1.46 | 64.5 |
| 13 | 0.2 | 0.2 | 0.5 | 1.5 | 5 | 61.8 | 0.15 | 1.36 | 66.6 |
| 14 | 0.2 | 0.2 | 0.5 | 0.25 | 5 | | 0.29 | 0.73 | |
| 15 | 0.2 | 0.2 | 0.6 | 1.5 | 5 | 60 | 0.1 | 1.3 | 65.1 |
| 16 | 0.2 | 0.2 | 0.6 | 1 | 5 | 58.5 | 0.48 | 0.79 | 62.6 |
| 17 | 0.2 | 0 | 0.6 | 1.25 | 5 | | 0.28 | 1.37 | 66.8 |
| 18 | 0.2 | 0 | 0.7 | 1.25 | 6 | 58.6 | 0.19 | 1.76 | 62.8 |
| 19 | 0.2 | 0 | 0.5 | 1 | 6 | 62 | 0.71 | 1.69 | 63.8 |
| 20 | 0.2 | 0 | 0.75 | 1 | 6 | 62.5 | 0.94 | 1.61 | 64 |
| 21 | 0.2 | 0 | 0.6 | 1 | 6 | | 0.58 | 0.8 | |
| 22 | 0.2 | 0 | 0.6 | 1 | 6 | | 0.67 | 0.98 | |
| 23 | 0.2 | 0 | 0.6 | 1 | 6 | | 0.61 | 0.89 | |
| 24 | 0.2 | 0 | 0.6 | 1 | 6 | | 0.52 | 1.12 | |
| 25 | 0.2 | 0 | 0.6 | 1 | 6 | | 0.56 | 1.12 | |

TABLE 4

Examples 9-25 Pulp Fiber Analysis Results

| | | Percent Fines | | Mean Length mm | | | Mean Curl | | |
|---|---|---|---|---|---|---|---|---|---|
| Example | Retention Hours | Arithmetic | Length Weighted | Arithmetic | Length Weighted | Weight Weighted | Arithmetic | Length Weighted | Kink Index |
| Base | Control | 38.80 | 8.25 | 0.534 | 1.232 | 2.083 | 0.073 | 0.076 | 1.35 |
| 9 | 0 | 44.77 | 11.17 | 0.454 | 1.138 | 2.017 | 0.146 | 0.157 | 2.20 |
| 9 | 12 | 44.71 | 11.80 | 0.440 | 1.002 | 1.707 | 0.144 | 0.153 | 2.17 |
| 10 | 0 | 40.31 | 9.48 | 0.488 | 1.157 | 2.009 | 0.166 | 0.176 | 2.37 |
| 10 | 12 | 45.83 | 11.83 | 0.442 | 1.098 | 1.957 | 0.159 | 0.176 | 2.27 |
| 11 | 0 | 46.98 | 12.67 | 0.423 | 1.072 | 1.905 | 0.173 | 0.197 | 2.33 |
| 11 | 0 | 46.98 | 12.67 | 0.423 | 1.072 | 1.905 | 0.173 | 0.197 | 2.33 |
| 11 | 24 | 47.20 | 12.95 | 0.419 | 1.000 | 1.731 | 0.173 | 0.191 | 2.36 |
| 11 | 0 | 45.58 | 11.95 | 0.436 | 1.063 | 1.890 | 0.178 | 0.212 | 2.26 |
| 11 | 72 | 45.73 | 12.36 | 0.418 | 0.989 | 1.772 | 0.175 | 0.214 | 2.27 |
| 12 | 0 | 48.66 | 14.18 | 0.393 | 0.970 | 1.767 | 0.191 | 0.211 | 2.31 |
| 12 | 24 | 46.02 | 12.07 | 0.432 | 1.083 | 1.970 | 0.172 | 0.186 | 2.33 |
| 12 | 0 | 45.23 | 12.24 | 0.415 | 0.976 | 1.753 | 0.164 | 0.186 | 2.23 |
| 12 | 72 | 46.67 | 13.09 | 0.412 | 0.696 | 1.778 | 0.186 | 0.219 | 2.38 |
| 13 | 0 | 49.88 | 14.91 | 0.382 | 0.958 | 1.764 | 0.183 | 0.201 | 2.44 |
| 13 | 12 | 46.65 | 12.57 | 0.524 | 1.028 | 1.782 | 0.166 | 0.182 | 2.25 |
| 13 | 24 | 46.65 | 12.57 | 0.425 | 1.028 | 1.782 | 0.166 | 0.182 | 2.25 |
| 13 | 72 | 46.77 | 12.62 | 0.422 | 1.025 | 1.829 | 0.169 | 0.188 | 2.27 |
| 13 | 0 | 45.45 | 11.83 | 0.433 | 1.076 | 1.934 | 0.179 | 0.201 | 2.36 |
| 13 | 72 | 47.25 | 13.34 | 0.404 | 0.978 | 1.786 | 0.184 | 0.217 | 2.32 |
| 14 | 0 | 44.38 | 11.34 | 0.447 | 1.102 | 1.974 | 0.185 | 0.205 | 2.53 |
| 14 | 24 | 44.90 | 11.40 | 0.450 | 1.121 | 1.999 | 0.159 | 0.174 | 2.22 |
| 14 | 72 | 45.08 | 11.23 | 0.455 | 1.131 | 1.999 | 0.152 | 0.170 | 2.16 |
| 14 | 0 | 45.94 | 12.57 | 0.417 | 0.974 | 1.722 | 0.173 | 0.205 | 2.20 |
| 14 | 72 | 45.70 | 12.24 | 0.411 | 0.991 | 1.913 | 0.183 | 0.215 | 2.40 |
| 15 | 0 | 46.38 | 12.11 | 0.432 | 1.090 | 2.008 | 0.167 | 0.184 | 2.31 |
| 15 | 24 | 47.30 | 12.70 | 0.422 | 1.037 | 1.824 | 0.163 | 0.179 | 2.24 |
| 15 | 0 | 46.30 | 13.43 | 0.394 | 0.899 | 1.563 | 0.202 | 0.232 | 2.38 |
| 16 | 0 | 45.12 | 11.56 | 0.448 | 1.117 | 1.989 | 0.176 | 0.191 | 2.36 |
| 16 | 24 | 46.04 | 11.98 | 0.433 | 1.103 | 2.034 | 0.170 | 0.191 | 2.28 |
| 16 | 0 | 47.25 | 13.52 | 0.397 | 0.941 | 1.683 | 0.192 | 0.233 | 2.32 |
| 17 | 0 | 47.06 | 12.58 | 0.427 | 1.060 | 1.899 | 0.172 | 0.186 | 2.34 |
| 17 | 24 | 46.56 | 11.83 | 0.439 | 1.116 | 2.022 | 0.173 | 0.193 | 2.32 |
| 17 | 0 | 47.11 | 13.81 | 0.391 | 0.915 | 1.611 | 0.181 | 0.199 | 2.24 |
| 18 | 0 | 49.46 | 13.60 | 0.409 | 1.063 | 2.018 | 0.181 | 0.196 | 2.40 |
| 18 | 24 | 46.40 | 11.69 | 0.445 | 1.148 | 2.029 | 0.165 | 0.178 | 2.30 |
| 18 | 0 | 47.38 | 14.01 | 0.383 | 0.921 | 1.716 | 0.192 | 0.219 | 2.31 |
| 19 | 0 | 43.90 | 11.16 | 0.453 | 1.126 | 2.042 | 0.166 | 0.184 | 2.24 |
| 19 | 24 | 44.67 | 11.58 | 0.438 | 1.026 | 1.774 | 0.156 | 0.170 | 2.18 |
| 19 | 0 | 47.02 | 13.70 | 0.391 | 0.901 | 1.603 | 0.188 | 0.217 | 2.27 |
| 20 | 0 | 43.05 | 10.83 | 0.449 | 1.022 | 1.739 | 0.170 | 0.186 | 2.41 |
| 20 | 24 | 46.02 | 12.07 | 0.434 | 1.059 | 1.851 | 0.161 | 0.171 | 2.23 |
| 20 | 0 | 44.75 | 12.26 | 0.420 | 0.978 | 1.705 | 0.181 | 0.219 | 2.25 |

TABLE 4-continued

Examples 9-25 Pulp Fiber Analysis Results

| | | Percent Fines | | Mean Length mm | | | Mean Curl | | |
|---|---|---|---|---|---|---|---|---|---|
| Example | Retention Hours | Arithmetic | Length Weighted | Arithmetic | Length Weighted | Weight Weighted | Arithmetic | Length Weighted | Kink Index |
| 21 | 0 | 97.10 | 81.68 | 0.461 | 1.191 | 2.193 | 0.178 | 0.191 | 2.47 |
| 21 | 0 | 97.88 | 86.65 | 0.430 | 1.010 | 1.764 | 0.164 | 0.186 | 2.41 |
| 21 | 12 | 50.75 | 71.85 | 0.402 | 0.977 | 1.789 | 0.179 | 0.214 | 2.28 |
| 21 | 12 | 53.12 | 75.26 | 0.406 | 0.929 | 1.673 | 0.184 | 0.217 | 2.23 |
| 22 | 0 | 97.67 | 85.76 | 0.436 | 1.012 | 1.762 | 0.160 | 0.169 | 2.25 |
| 22 | 0 | | | | | | | | |
| 22 | 12 | 52.40 | 74.91 | 0.408 | 0.939 | 1.634 | 0.180 | 0.213 | 2.31 |
| 22 | 12 | 53.55 | 74.53 | 0.429 | 1.007 | 1.796 | 0.155 | 0.177 | 2.19 |
| 23 | 0 | 97.53 | 84.56 | 0.444 | 1.071 | 1.881 | 0.164 | 0.178 | 2.29 |
| 23 | 0 | | | | | | | | |
| 23 | 12 | 51.73 | 73.24 | 0.424 | 1.023 | 1.801 | 0.180 | 0.199 | 2.36 |
| 23 | 12 | 52.08 | 73.58 | 0.419 | 1.031 | 1.912 | 0.161 | 0.185 | 2.21 |
| 24 | 0 | 97.53 | 84.84 | 0.436 | 1.038 | 1.792 | 0.157 | 0.167 | 2.22 |
| 24 | 0 | | | | | | | | |
| 24 | 12 | 53.42 | 72029 | 0.432 | 1.078 | 2.070 | 0.172 | 0.191 | 2.25 |
| 24 | 12 | 53.33 | 73.75 | 0.435 | 1.033 | 1.847 | 0.169 | 0.186 | 2.25 |
| 25 | 12 | 55.96 | 75.20 | 0.466 | 1.105 | 1.974 | 0.179 | 0.201 | 2.31 |
| 25 | 0 | 97.78 | 85.49 | 0.429 | 1.058 | 1.909 | 0.178 | 0.191 | 2.35 |
| 25 | 0 | | | | | | | | |
| 25 | 12 | 53.12 | 75.46 | 0.421 | 0.983 | 1.726 | 0.175 | 0.192 | 2.25 |

TABLE 5

Examples 26-35 Pulp Fiber Analysis Data

| | | Percent Fines | | Mean Length mm | | | Mean Curl | | |
|---|---|---|---|---|---|---|---|---|---|
| Example | Ret | Arithmetic | Length Weighted | Arithmetic | Length Weighted | Weight Weighted | Arithmetic | Length Weighted | Kink Index |
| Base | | 39.4 | 10.74 | 0.422 | 0.694 | 0.893 | 0.042 | 0.044 | 0.76 |
| 26 | 0 | 41.88 | 12.39 | 0.395 | 0.648 | 0.827 | 0.076 | 0.079 | 1.17 |
| 26 | 12 | 42.7 | 12.56 | 0.39 | 0.66 | 0.88 | 0.073 | 0.078 | 1.14 |
| 27 | 0 | 39.8 | 11.08 | 0.417 | 0.683 | 0.866 | 0.038 | 0.039 | 0.55 |
| 27 | 12 | 39.8 | 10.74 | 0.421 | 0.688 | 0.861 | 0.038 | 0.039 | 0.53 |
| 28 | 0 | 39.52 | 10.46 | 0.439 | 0.722 | 0.925 | 0.035 | 0.036 | 0.5 |
| 28 | 12 | 41.17 | 11.26 | 0.418 | 0.693 | 0.875 | 0.037 | 0.037 | 0.52 |
| 29 | 0 | 45.15 | 14.53 | 0.36 | 0.617 | 0.837 | 0.082 | 0.084 | 1.31 |
| F | | 52.27 | 9.36 | 0.6 | 1.751 | 2.633 | 0.122 | 0.157 | 1.33 |
| 30 | 0 | 54.09 | 9.28 | 0.623 | 1.913 | 2.86 | 0.089 | 0.103 | 1.03 |
| 30 | 72 | 53.83 | 8.89 | 0.651 | 2 | 2.915 | 0.077 | 0.094 | 0.98 |
| F | | 55.9 | 16.24 | 0.377 | 0.794 | 1.087 | 0.109 | 0.121 | 1.67 |
| 31 | 0 | 55.08 | 15.46 | 0.385 | 0.817 | 1.152 | 0.083 | 0.089 | 1.48 |
| 31 | 72 | 55.27 | 16.05 | 0.373 | 0.786 | 1.087 | 0.065 | 0.071 | 1.17 |
| G | | 56.42 | 7.33 | 0.798 | 2.399 | 3.238 | 0.087 | 0.097 | 1.27 |
| 32 | 0 | 58.12 | 8.46 | 0.717 | 2.293 | 3.18 | 0.197 | 0.211 | 2.4 |
| 32 | 72 | 51.04 | 6.2 | 0.859 | 2.395 | 3.216 | 0.19 | 0.209 | 2.33 |
| 33 | 0 | 55.92 | 7.59 | 0.749 | 2.283 | 3.134 | 0.192 | 0.202 | 2.42 |
| 33 | 72 | 53.65 | 7.12 | 0.78 | 2.259 | 3.056 | 0.192 | 0.209 | 2.31 |
| 33 | 3 | 55.77 | 7.98 | 0.748 | 2.304 | 3.228 | 0.213 | 0.233 | 2.42 |
| 33 | 3 | 56.16 | 7.68 | 0.744 | 2.319 | 3.198 | 0.201 | 0.215 | 2.42 |
| 33 | 72 | 55.4 | 7.92 | 0.738 | 2.238 | 3.089 | 0.205 | 0.225 | 2.32 |
| 33 | 72 | 54.4 | 7.42 | 0.772 | 2.265 | 3.114 | 0.199 | 0.214 | 2.32 |
| H | | 63.73 | 16.29 | 0.379 | 0.935 | 1.32 | 0.082 | 0.091 | 1.4 |
| 34 | 0 | 61.73 | 17.16 | 0.365 | 0.835 | 1.131 | 0.159 | 0.169 | 2.21 |
| 34 | 12 | 60.12 | 15.82 | 0.383 | 0.873 | 1.172 | 0.145 | 0.154 | 2.15 |
| 35 | 0 | 57.65 | 14.5 | 0.408 | 0.893 | 1.195 | 0.141 | 0.153 | 2.07 |
| 35 | 12 | 59.73 | 15.34 | 0.398 | 0.892 | 1.181 | 0.127 | 0.139 | 1.99 |

TABLE 6

Examples 26-35 Pulp Operating Conditions

| Example | Pulp | Cons % | Pulp Flow Kg/min | Run Time Min | Steam PSIG | Temp ° F. | Residence Min |
|---|---|---|---|---|---|---|---|
| 26 | Hardwood BCTMP | 35 | 0.5 | 3 | 15 | 250 | 10 |

TABLE 6-continued

Examples 26-35 Pulp Operating Conditions

| Example | Pulp | Cons % | Pulp Flow Kg/min | Run Time Min | Steam PSIG | Temp ° F. | Residence Min |
|---|---|---|---|---|---|---|---|
| 27 | Hardwood BCTMP | 35 | 0.5 | 3 | 25 | 270 | 10 |
| 28 | Hardwood BCTMP | 35 | 0.5 | 3 | 15 | 250 | 10 |
| 29 | Hardwood BCTMP | 35 | 0.5 | 3 | 15 | 250 | 10 |
| 30 | SW | 20 | 0.5 | 3 | 15 | 250 | 5 |
| 31 | HW | 23 | 0.5 | 3 | 15 | 250 | 5 |
| 32 | SW | 35 | 0.5 | 3 | 15 | 250 | 5 |
| 33 | SW | 35 | 0.5 | 3 | 15 | 250 | 5 |
| 34 | HW | 35 | 0.5 | 3 | 15 | 250 | 5 |
| 35 | HW | 35 | 0.5 | 3 | 15 | 250 | 5 |

TABLE 7

Examples 21-25 Trial Fiber Analysis Data

| | | | Percent Fines | | Mean Length mm | | | Mean Curl | | |
|---|---|---|---|---|---|---|---|---|---|---|
| Example | Ret Hour | Sample | Arithmetic | Length Weighted | Arithmetic | Length Weighted | Weight Weighted | Arithmetic | Length Weighted | Kink Index |
| 21 | 0 | Post Refiner | 97.1 | 81.68 | 0.461 | 1.191 | 2.193 | 0.178 | 0.191 | 2.47 |
| 21 | 0 | Washed | 97.88 | 86.65 | 0.43 | 1.01 | 1.764 | 0.164 | 0.186 | 2.41 |
| 21 | 12 | Cold Storage | 50.75 | 71.85 | 0.402 | 0.977 | 1.789 | 0.179 | 0.214 | 2.28 |
| 21 | 12 | Cold Storage | 53.12 | 75.26 | 0.406 | 0.928 | 1.673 | 0.184 | 0.217 | 2.23 |
| 22 | 0 | Post Refiner | 97.67 | 85.76 | 0.436 | 1.012 | 1.762 | 0.16 | 0.169 | 2.25 |
| 22 | 0 | Washed | | | | | | | | |
| 22 | 12 | Cold Storage | 52.4 | 74.91 | 0.408 | 0.939 | 1.634 | 0.18 | 0.213 | 2.31 |
| 22 | 12 | Cold Storage | 53.55 | 74.53 | 0.429 | 1.007 | 1.796 | 0.155 | 0.177 | 2.19 |
| 23 | 0 | Post Refiner | 97.53 | 84.56 | 0.444 | 1.071 | 1.881 | 0.164 | 0.178 | 2.29 |
| 23 | 0 | Washed | | | | | | | | |
| 23 | 12 | Cold Storage | 51.73 | 73.24 | 0.424 | 1.023 | 1.801 | 0.18 | 0.199 | 2.36 |
| 23 | 12 | Cold Storage | 52.08 | 73.58 | 0.419 | 1.031 | 1.912 | 0.161 | 0.185 | 2.21 |
| 24 | 0 | Post Refiner | 97.53 | 84.84 | 0.436 | 1.038 | 1.792 | 0.157 | 0.167 | 2.22 |
| 24 | 0 | Washed | | | | | | | | |
| 24 | 12 | Cold Storage | 53.42 | 72.29 | 0.432 | 1.078 | 2.07 | 0.172 | 0.191 | 2.25 |
| 24 | 12 | Cold Storage | 53.33 | 73.75 | 0.435 | 1.033 | 1.847 | 0.169 | 0.186 | 2.25 |
| 25 | 0 | Post Refiner | 97.78 | 85.49 | 0.429 | 1.058 | 1.909 | 0.178 | 0.191 | 2.35 |
| 25 | 0 | Washed | | | | | | | | |
| 25 | 12 | Cold Storage | 53.12 | 75.46 | 0.421 | 0.983 | 1.726 | 0.175 | 0.192 | 2.25 |
| 25 | 12 | Cold Storage | 55.96 | 75.2 | 0.466 | 1.105 | 1.974 | 0.179 | 0.201 | 2.31 |

TABLE 8

Latency Testing Fiber Analysis Results

| | | Percent Fines | | Mean Length mm | | | Mean Curl | | |
|---|---|---|---|---|---|---|---|---|---|
| Example | Minutes | Fines Arithmetic | Fines LW | Length Arithmetic | Length LW | Length LW | Curl Arithmetic | Curl LW | Kink Index |
| 33 | 0 | 55.92 | 7.59 | 0.749 | 2.283 | 3.134 | 0.192 | 0.202 | 2.42 |
| 33 | 5 | 60.83 | 9.26 | 0.674 | 2.279 | 3.217 | 0.193 | 0.212 | 2.32 |
| 33 | 10 | 61.64 | 10.22 | 0.628 | 2.177 | 3.172 | 0.181 | 0.193 | 2.36 |
| 33 | 15 | 57 | 8.76 | 0.696 | 2.209 | 3.146 | 0.174 | 0.189 | 2.22 |
| 33 | 20 | 59.37 | 9.14 | 0.692 | 2.255 | 3.151 | 0.156 | 0.166 | 2.16 |
| 33 | 25 | 55.96 | 8.41 | 0.713 | 2.25 | 3.187 | 0.144 | 0.158 | 2.05 |
| 33 | 30 | 55.9 | 7.99 | 0.774 | 2.316 | 3.227 | 0.147 | 0.159 | 2 |
| 33 | 35 | 57.14 | 8.56 | 0.713 | 2.278 | 3.169 | 0.149 | 0.161 | 2.02 |
| 33 | 40 | 54.16 | 7.13 | 0.795 | 2.358 | 3.217 | 0.144 | 0.158 | 2.03 |
| 34 | 0 | 61.73 | 17.16 | 0.365 | 0.835 | 1.131 | 0.159 | 0.169 | 2.21 |
| 34 | 5 | 60.38 | 15.46 | 0.394 | 0.896 | 1.185 | 0.163 | 0.174 | 2.3 |
| 34 | 10 | 60.08 | 16.06 | 0.386 | 0.86 | 1.139 | 0.144 | 0.154 | 2.21 |
| 34 | 15 | 60.4 | 15.89 | 0.394 | 0.883 | 1.166 | 0.144 | 0.154 | 2.16 |
| 34 | 20 | 60.33 | 16.28 | 0.391 | 0.88 | 1.194 | 0.134 | 0.143 | 2.13 |
| 34 | 25 | 61.42 | 16.43 | 0.384 | 0.89 | 1.222 | 0.142 | 0.151 | 2.22 |
| 34 | 30 | 59.98 | 15.98 | 0.395 | 0.897 | 1.213 | 0.141 | 0.152 | 2.22 |

TABLE 8-continued

Latency Testing Fiber Analysis Results

| | | Percent Fines | | Mean Length mm | | | Mean Curl | | |
|---|---|---|---|---|---|---|---|---|---|
| Example | Minutes | Fines Arithmetic | Fines LW | Length Arithmetic | Length LW | Length LW | Curl Arithmetic | Curl LW | Kink Index |
| 34 | 35 | 59.35 | 15.39 | 0.405 | 0.891 | 1.16 | 0.137 | 0.146 | 2.08 |
| 34 | 40 | 60.17 | 15.65 | 0.398 | 0.895 | 1.181 | 0.138 | 0.15 | 2.2 |
| 35 | 0 | 57.65 | 14.5 | 0.408 | 0.893 | 1.195 | 1.141 | 0.153 | 2.07 |
| 35 | 10 | 59.1 | 15.35 | 0.406 | 0.908 | 1.234 | 0.126 | 0.139 | 2.04 |
| 35 | 15 | 60.12 | 15.92 | 0.401 | 0.899 | 1.192 | 0.132 | 0.145 | 2.07 |
| 35 | 20 | 60.08 | 15.96 | 0.401 | 0.901 | 1.208 | 0.127 | 0.14 | 1.97 |
| 35 | 25 | 58.81 | 15.3 | 0.41 | 0.903 | 1.2 | 0.127 | 0.138 | 2.02 |
| 35 | 30 | 60.12 | 16.05 | 0.397 | 0.906 | 1.254 | 0.127 | 0.138 | 2 |
| 35 | 35 | 58.52 | 15.02 | 0.411 | 0.906 | 1.213 | 0.125 | 0.137 | 2.06 |
| 35 | 40 | 60.2 | 16.2 | 0.398 | 0.889 | 1.193 | 0.124 | 0.137 | 2.07 |

Note: Latency Procedure
Samples were diluted to about 0.4% consistency with Tap water at 125° F.
Samples were run for 40 minutes in the lab disintegrator with OP Test run every 5 minutes.

Figure 2:
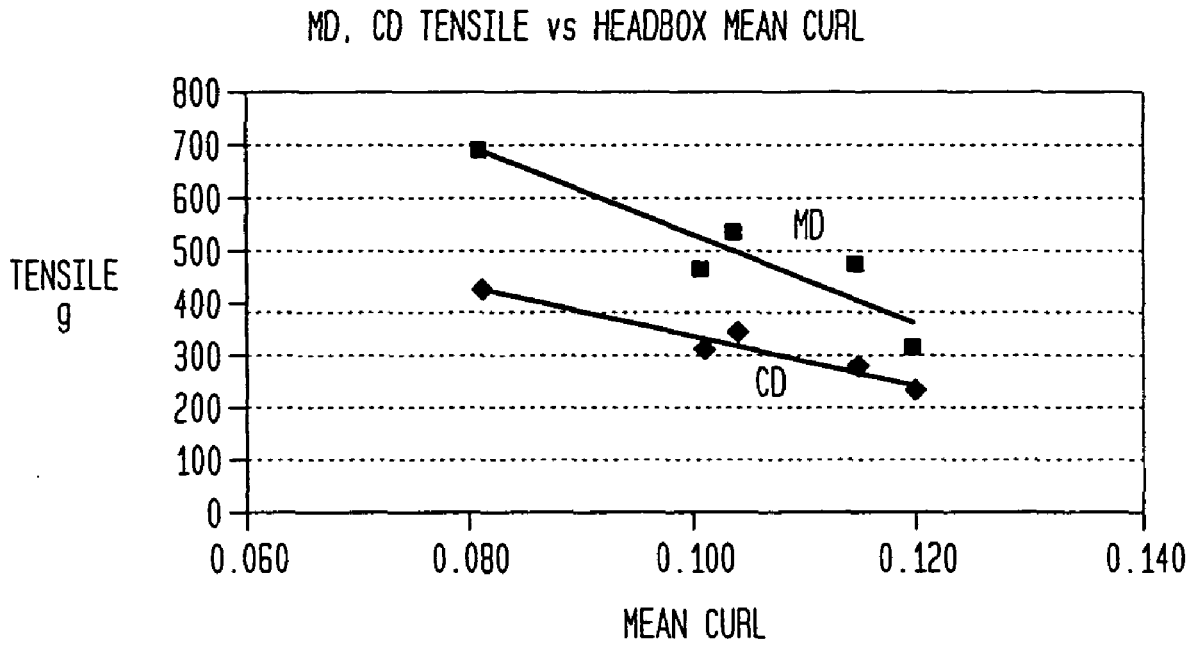
FIG. 2 is a plot of length-weighted mean curl in the headbox vs. tensile for a sheet made utilizing fiber prepared in accordance with the invention.
Figure 3:
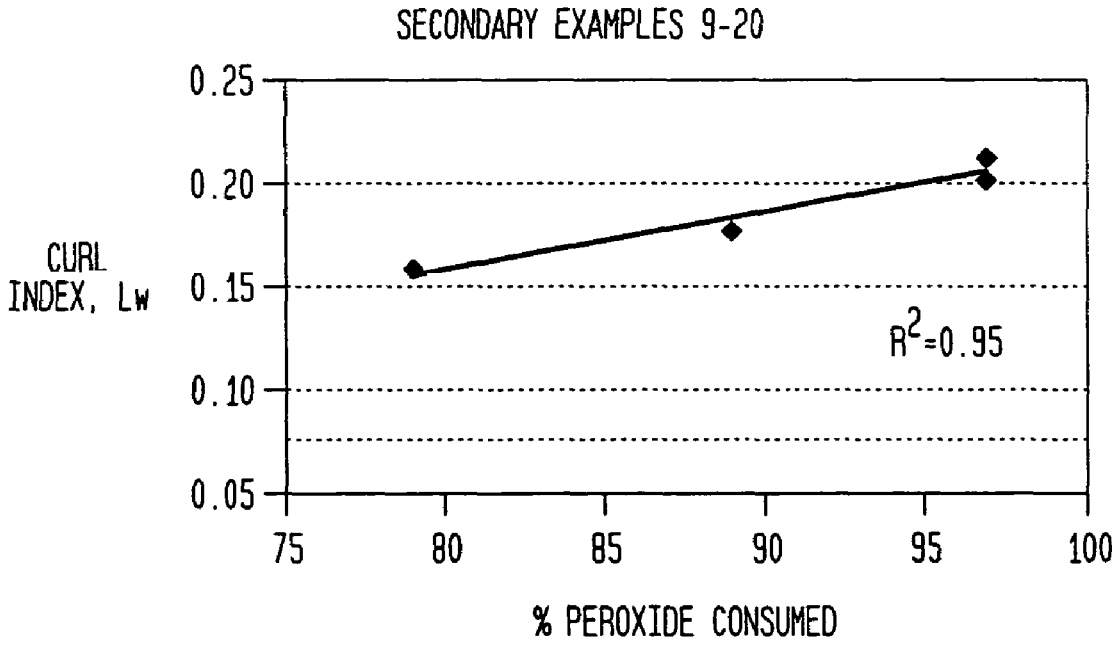
FIG. 3 is a plot of length weighted curl index vs. peroxide consumed in the process according to the present invention.
Figure 4:
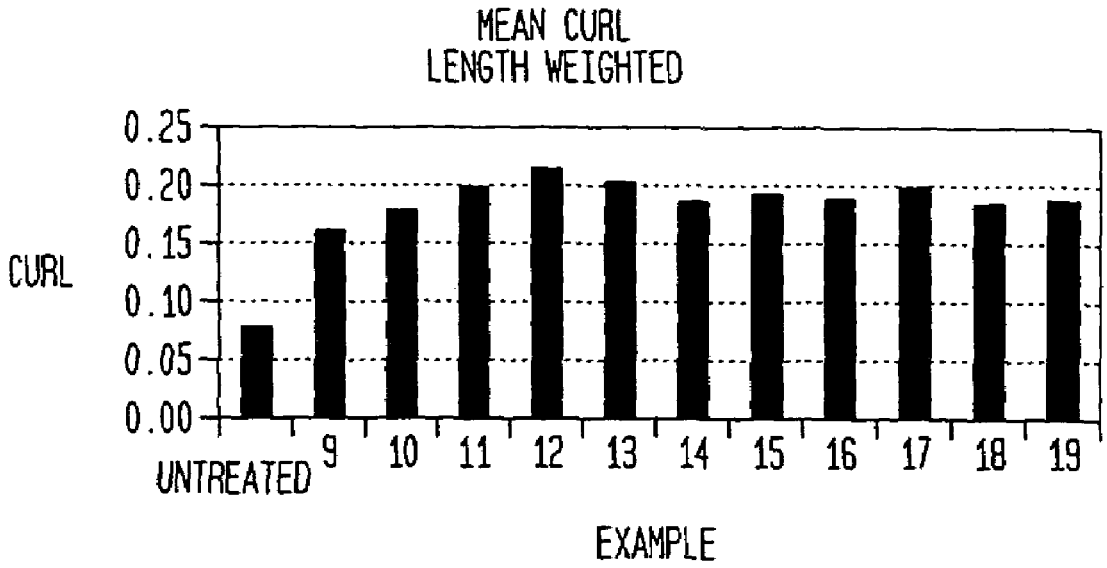
FIGS. 4 and 5 are histograms showing kink index and curl index (length weighted) for fiber treated in accordance with the invention.
Figure 6:
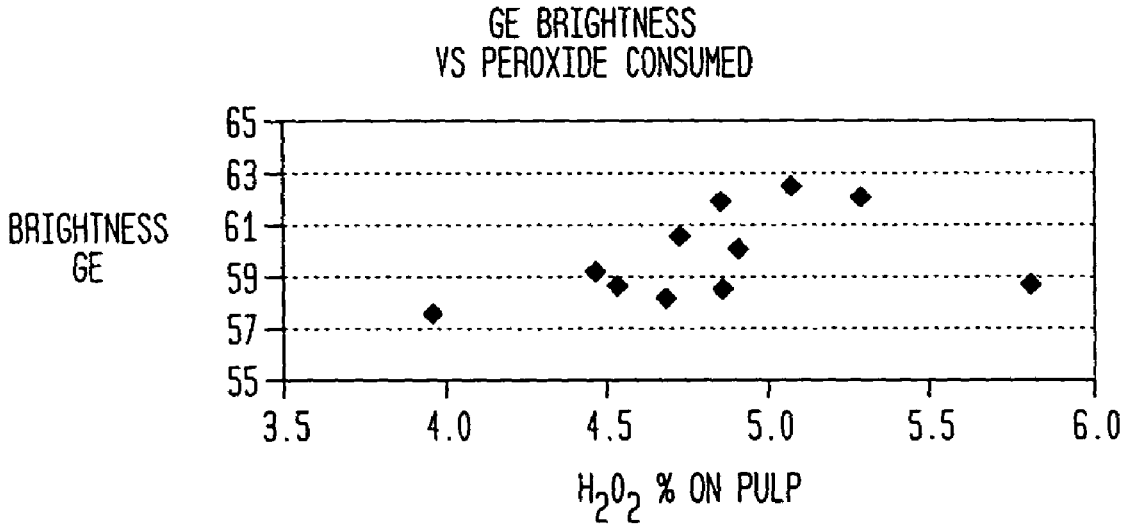
FIGS. 6 and 7 are plots of brightness vs. peroxide consumed and length weighted curl index vs. peroxide consumed. As will be appreciated from the Figures, the curl increases with hydrogen peroxide consumption.
Figure 7:
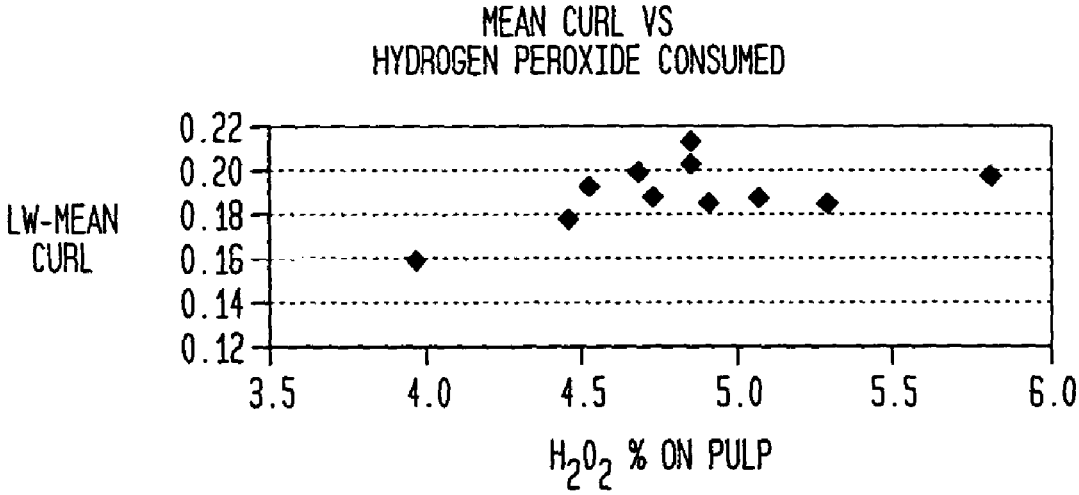

The properties and utility of the bleached and curled fiber is further appreciated by reference to FIGS. 2-7. Specifically:

FIG. 2 is a plot of length-weighted mean curl in the headbox vs. tensile for a sheet made utilizing fiber prepared in accordance with the invention;

FIG. 3 is a plot of length weighted curl index vs. peroxide consumed in the process according to the present invention;

FIGS. 4 and 5 are histograms showing kink index and curl index (length weighted) for fiber treated in accordance with the invention; and FIG. 6 and 7 are plots of brightness vs. peroxide consumed and length weighted curl vs. peroxide consumed. As will be appreciated from the Figures, the curl increases with hydrogen peroxide consumption.

A pilot paper machine trial was performed utilizing curled and bleached fiber from the batch refiner. A sample of the paper which was used in Examples 9-25 was used as the control and curled pulp. The paper was wetted to 35% consistency and run through the lab pilot pulp breaker before use in the refiner. Utilizing a bleaching/-curling process five batches of pulp were produced. The five batches of pulp were combined in the machine chest, diluted to about 2% consistency and continuously agitated for the trial duration. The curl at the machine chest and headbox was monitored for each cell. In Table 9 the base sheet results are given.

TABLE 9

Base Sheet Results

| | | Example | | | | |
|---|---|---|---|---|---|---|
| | | 36 | 37 | 38 | 39 | 40 |
| % Refiner Bleached Fiber | | 0 | 20 | 40 | 60 | 100 |
| Basis Weight | lb/3000 $ft^2$ | 8.9 | 8.5 | 8.5 | 8.3 | 7.2 |
| Caliper | In | 33.7 | 34.0 | 34.6 | 36.5 | 34.9 |
| Bulk | $ft^3$/lb | 0.118 | 0.125 | 0.127 | 0.137 | 0.151 |
| MD Tensile | | | | | | |
| Max Load | g | 679.737 | 529.313 | 462.691 | 470.589 | 308.430 |
| % Disp | % | 25.667 | 24.426 | 23.296 | 25.759 | 24.667 |
| CD Tensile | | | | | | |
| Max Load | g | 424.431 | 340.157 | 308.716 | 274.995 | 230.614 |
| % Disp | % | 4.500 | 5.296 | 4.981 | 6.037 | 6.370 |
| Headbox Mean Curl | | 0.081 | 0.104 | 0.101 | 0.115 | 0.120 |
| Porofil | | 8.3 | 8.6 | 8.4 | 9.4 | 10.3 |

What is claimed is:

1. An absorbent sheet formed by:

(a) bleaching cellulosic fiber and producing fiber with a durable elevated curl index by way of a process comprising:

(1) feeding a first cellulosic pulp including Kraft fiber to a refining gap defined between opposed surfaces, at least one of the surfaces being rotatable with respect to its opposed surface;

(2) concurrently heat-treating, bleaching and convolving the cellulosic fiber pulp including Kraft fiber in the refining gap at a temperature of from about 230° F. to about 370° F. and a pressure of from about 5 to about 150 psig, the treatment taking place at high consistency in a bleaching liquor including a peroxide bleaching agent under conditions selected so as to preclude substantial fibrillation and attendant paper strength and fiber bonding development;

(3) recovering said pulp wherein the length weighted curl index of the treated fiber is at least about 0.12; and (b) incorporating the Kraft fiber with the elevated curl index provided by way of steps (a)(1), (a)(2) and (a)(3) in the absorbent sheet by mixing pulp prepared by way of steps (a)(1), (a)(2) and (a)(3) with a second pulp having a lower length weighted curl index to produce a mixed pulp having a length weighted curl index intermediate the fiber with the elevated curl index and the second pulp; and forming an absorbent sheet from the mixed pulp.

2. The absorbent sheet according to claim 1, wherein said step of heat-treating and convolving said fiber has a duration of from about 0.01 to about 20 seconds.

3. The absorbent sheet according to claim 1, wherein said step of heat-treating and convolving said fiber has a duration of less than about 10 seconds.

4. The absorbent sheet according to claim 1, wherein said step of heat-treating and convolving said fiber has a duration of less than about 5 seconds.

5. The absorbent sheet according to claim 1, wherein said step of heat-treating and convolving said fiber has a duration of less than about 2 seconds.

6. The absorbent sheet according to claim 1, wherein mechanical energy input to said fiber during said heat-treating and convolving step is less than about 2 HP day/ton.

7. The absorbent sheet according to claim 1, wherein said fiber comprises secondary fiber.

8. The absorbent sheet according to claim 1, wherein said fiber consists essentially of secondary fiber.

9. The absorbent sheet according to claim 1, wherein said fiber consists of secondary fiber.

10. An absorbent sheet incorporating secondary fiber which has been concurrently bleached, heat-treated and convolved in a refining gap, wherein the step of heat-treating and convolving the fiber had a duration of from about 0.01 to about 20 seconds, and the treatment was carried out at a temperature of from about 230° F. to about 370° F. and at a pressure of from about 5 to about 150 psig in the presence of a peroxide bleaching agent and wherein said secondary fiber has a length weighted curl index of at least about 0.12, the absorbent sheet also containing secondary fiber having a lower length weighted curl index than the concurrently bleached, heat treated and convolved fiber which is mixed with the heat-treated and convolved secondary fiber prior to forming the sheet.

11. The absorbent sheet according to claim 10, wherein said step of heat-treating and convolving said secondary fiber had a duration of less than about 10 seconds.

12. The absorbent sheet according to claim 10, wherein said step of heat-treating and convolving said secondary fiber had a duration of less than about 5 seconds.

13. The absorbent sheet according to claim 10, wherein said step of heat-treating and convolving said secondary fiber had duration of less than about 2 seconds.

14. The absorbent sheet according to claim 10, wherein mechanical energy input to said secondary fiber during said heat-treating and convolving step is less than about 2 HP day/ton.

15. The absorbent sheet according to claim 10, wherein said sheet has a porofil value of at least 8.6.

16. The absorbent sheet according to claim 15, wherein said sheet has a porofil value of at least 9.4.

17. The absorbent sheet according to claim 15, wherein said sheet has a porofil value of at least 10.3.

18. An absorbent sheet formed by:

(a) bleaching cellulosic fiber and producing fiber with a durable elevated curl index by way of a process comprising:

(1) feeding a first cellulosic pulp including Kraft fiber to a refining gap defined between opposed surfaces, at least one of the surfaces being rotatable with respect to its opposed surface;

(2) concurrently heat-treating, bleaching and convolving the cellulosic fiber pulp including Kraft fiber in the refining gap at a temperature of from about 230° F. to about 370° F. and a pressure of from about 5 to about 150 psig, the treatment taking place at high consistency in a bleaching liquor including a peroxide bleaching agent under conditions selected so as to preclude substantial fibrillation and attendant paper strength and fiber bonding development;

(3) recovering said pulp;

(4) wherein the length weighted curl index of the treated fiber is at least 20% higher than the length weighted curl index of the fiber prior to treatment;

(5) wherein further, the step of heat-treating and convolving the fiber has a duration of from about 0.01 to about 20 seconds; and (b) incorporating the Kraft fiber with the elevated curl index provided by way of steps (a)(1), (a)(2), (a)(3), (a)(4) and (a)(5) in the absorbent sheet by mixing pulp prepared by way of steps (a)(1)(a)(2), (a)(3), (a)(4) and (a)(5) with a second pulp having a lower length weighted curl index to produce a pulp having a length weighted curl index intermediate the fiber with the elevated curl index and the second pulp; and forming an absorbent sheet from the mixed pulp.

19. The absorbent sheet according to claim 18, wherein the step of concurrently heat-treating and convolving the fiber is carried out at a pressure of from about 10 psig to about 90 psig.

* * * * *

UNITED STATES PATENT AND TRADEMARK OFFICE

CERTIFICATE OF CORRECTION

PATENT NO. : 7,291,247 B2
APPLICATION NO. : 10/625086
DATED : November 6, 2007
INVENTOR(S) : Jeffrey A. Lee It is certified that error appears in the above-identified patent and that said Letters Patent is hereby corrected as shown below:

In Column 1, line 62, delete "his" and insert --its--;
In Column 1, line 67, insert --%-- after "20";
In Column 2, line 16, insert --are-- after "they";
In Column 3, line 51, delete "processed" and insert --processes--;
In Column 5, line 34, delete "and that the" and insert --where--;
In Column 5, line 35, delete "which";
In Column 5, line 36, insert --of-- after "area";
In Column 9, line 34, delete "kraft" and insert --Kraft--;
In Column 10, line 2, insert -- - -- after "non";
In Column 11, line 24, delete ")" after ".";
In Column 11, line 35, insert --(-- before "$W_2$";
In Column 11, line 44, delete "Tappi" and insert --TAPPI--;
In Column 13, line 13, delete "a";
In Column 13, line 13, insert -- - -- after "screw";
In Column 14, line 23, insert --were-- before "performed";
In Column 14, line 42, delete "appears" and insert --appear--;
In Table 2 (Columns 15-16), Example 8, delete "0.466" in the 5th column of the Table and insert --0.466--;
In Table 3 (Columns 17-18), delete the first instance of "DTPA" in the 3rd column of the Table;
In Table 3 (Columns 17-18), delete the first instance of "Caustic" in the 5th column of the Table;
In Table 4 (Columns 17-18), Example 14, delete "12.24" in the 4th column of the Table and insert --12.74--;
In Table 4 (Columns 19-20), Example 24, delete "72029" in the 4th column of the Table and insert --72.029--;
In Table 5 (Columns 19-20), change "Ret" after "Example" to --Ret Hour--;
In Table 6 (Columns 19-20), insert --Refiner Operation-- underneath "Examples 26-35 Pulp Operating Conditions";
In Column 23, line 56, delete "FIG." and insert --FIGS.--; and
In Column 26, line 42, insert --,-- after "(1)".

Signed and Sealed this

Twenty-second Day of June, 2010

David J. Kappos

David J. Kappos
*Director of the United States Patent and Trademark Office*